US007449638B2

(12) United States Patent
Clark et al.

(10) Patent No.: US 7,449,638 B2
(45) Date of Patent: Nov. 11, 2008

(54) TWISTED PAIR CABLE HAVING IMPROVED CROSSTALK ISOLATION

(75) Inventors: William T. Clark, Leominster, MA (US); Joseph J. Dellagala, Shrewsbury, MA (US); Robert Allen, Leominster, MA (US); Michael J. Rubera, Hubbardston, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

(21) Appl. No.: 11/608,320

(22) Filed: Dec. 8, 2006

(65) Prior Publication Data

US 2007/0163800 A1 Jul. 19, 2007

Related U.S. Application Data

(60) Provisional application No. 60/749,179, filed on Dec. 9, 2005.

(51) Int. Cl.
*H01B 11/02* (2006.01)

(52) U.S. Cl. ..... 174/113 C

(58) Field of Classification Search ..... 174/113 R, 174/113 C, 131 A

See application file for complete search history.

(56) References Cited

U.S. PATENT DOCUMENTS

| | | | |
|---|---|---|---|
| 1,008,370 | A | 11/1911 | Robillot |
| 1,132,452 | A | 3/1915 | Davis |
| 1,700,606 | A | 1/1929 | Beaver |
| 1,940,917 | A | 12/1933 | Okazaki |
| 1,977,209 | A | 10/1934 | Sargent |
| 1,995,201 | A | 3/1935 | Delon |
| 2,218,830 | A | 10/1940 | Rose et al. |
| 2,501,457 | A | 3/1950 | Thelin |
| 3,259,687 | A | 7/1966 | Oatess et al. |
| 3,328,510 | A | 6/1967 | White |
| 3,489,844 | A | 1/1970 | Motley |
| 3,603,715 | A | 9/1971 | Vinnhorst et al. |
| 3,644,659 | A | 2/1972 | Campbell |
| 3,881,052 | A | 4/1975 | Britz et al. |
| 3,945,974 | A | 3/1976 | Schwarcz et al. |
| 3,999,003 | A | 12/1976 | Chevrolet et al. |

(Continued)

FOREIGN PATENT DOCUMENTS

| | | |
|---|---|---|
| CA | 1164064 | 3/1984 |

(Continued)

OTHER PUBLICATIONS

International search report from International Application No. PCT/US2006/047113.

*Primary Examiner*—Chau N Nguyen
(74) *Attorney, Agent, or Firm*—Lowrie, Lando & Anastasi, LLP

(57) ABSTRACT

A cable that provides reduced alien crosstalk between similar twisted pairs in cables that are in close proximity to one another and/or crosstalk between twisted pairs of the cable. In one example, a cable includes a first twisted pair of insulated conductors, a second twisted pair of insulated conductors, a shaped separator positioned so as to separate the first twisted pair from the second twisted pair, and a jacket disposed about the first and second twisted pairs and the separator, wherein the shaped separator comprises a central arm and at least one enlarged portion disposed at a first end of the central arm.

15 Claims, 15 Drawing Sheets

U.S. PATENT DOCUMENTS

| | | | | |
|---|---|---|---|---|
| 4,034,148 | A | 7/1977 | Lang | |
| 4,319,940 | A | 3/1982 | Arroyo et al. | |
| 4,401,845 | A | 8/1983 | Odher et al. | |
| 4,412,094 | A | 10/1983 | Dougherty et al. | |
| 4,487,992 | A | 12/1984 | Tomita | |
| 4,654,476 | A | 3/1987 | Barnicol-Ottler et al. | |
| 4,697,051 | A | 9/1987 | Beggs et al. | |
| 4,777,325 | A | 10/1988 | Siwinski | |
| 4,778,246 | A | 10/1988 | Carroll | |
| 4,784,462 | A | 11/1988 | Priaroggia | |
| 4,804,702 | A | 2/1989 | Bartoszwk | |
| 4,873,393 | A | 10/1989 | Friesen et al. | |
| 5,073,682 | A | 12/1991 | Walling et al. | |
| 5,077,449 | A | 12/1991 | Cornibert et al. | |
| 5,097,099 | A | 3/1992 | Miller | |
| 5,107,076 | A | 4/1992 | Bullock et al. | |
| 5,132,488 | A | 7/1992 | Tessier et al. | |
| 5,132,491 | A | 7/1992 | Mulrooney et al. | |
| 5,149,915 | A | 9/1992 | Brunker et al. | |
| 5,155,304 | A | 10/1992 | Gossett et al. | |
| 5,180,890 | A | 1/1993 | Pendergrass et al. | |
| 5,424,491 | A | 6/1995 | Walling et al. | |
| 5,434,354 | A | 7/1995 | Baker et al. | |
| 5,493,071 | A | 2/1996 | Newmoyer et al. | |
| 5,514,837 | A | 5/1996 | Kenny et al. | |
| 5,563,377 | A | 10/1996 | Arpin et al. | |
| 5,574,250 | A | 11/1996 | Hardie et al. | |
| 5,606,151 | A | 2/1997 | Siekierka et al. | |
| 5,619,016 | A | 4/1997 | Newmoyer | |
| 5,658,406 | A | 8/1997 | Walling et al. | |
| 5,659,152 | A * | 8/1997 | Horie et al. | 174/113 R |
| 5,698,323 | A | 12/1997 | Keough et al. | |
| 5,699,467 | A | 12/1997 | Kojima et al. | |
| 5,789,711 | A | 8/1998 | Gaeris et al. | |
| 5,821,467 | A | 10/1998 | O'Brien et al. | |
| 5,834,697 | A | 11/1998 | Baker et al. | |
| 5,841,072 | A | 11/1998 | Gagnon et al. | |
| 5,883,334 | A | 3/1999 | Newmoyer et al. | |
| 5,936,205 | A | 8/1999 | Newmoyer | |
| 5,952,607 | A | 9/1999 | Friesen et al. | |
| 5,952,615 | A | 9/1999 | Prudhon | |
| 5,956,445 | A | 9/1999 | Deitz, Sr. et al. | |
| 5,969,295 | A | 10/1999 | Boucino et al. | |
| 6,037,546 | A | 3/2000 | Mottine et al. | |
| 6,091,025 | A | 7/2000 | Cotter et al. | |
| 6,140,587 | A | 10/2000 | Sackett | |
| 6,150,612 | A | 11/2000 | Grandy et al. | |
| 6,162,992 | A | 12/2000 | Clark et al. | |
| 6,222,129 | B1 | 4/2001 | Sierkerka et al. | |
| 6,248,954 | B1 | 6/2001 | Clark et al. | |
| 6,272,828 | B1 | 8/2001 | Walling et al. | |
| 6,297,454 | B1 | 10/2001 | Gareis | |
| 6,300,573 | B1 | 10/2001 | Horie et al. | |
| 6,303,867 | B1 | 10/2001 | Clark et al. | |
| 6,310,295 | B1 | 10/2001 | Despard | |
| 6,365,836 | B1 | 4/2002 | Blouin et al. | |
| 6,378,283 | B1 | 4/2002 | Barton | |
| 6,392,152 | B1 | 5/2002 | Mottine, Jr. et al. | |
| 6,441,308 | B1 | 8/2002 | Gagnon et al. | |
| 6,566,607 | B1 | 5/2003 | Walling | |
| 6,570,095 | B2 | 5/2003 | Clark et al. | |
| 6,596,944 | B1 | 7/2003 | Clark et al. | |
| 6,639,152 | B2 | 10/2003 | Glew et al. | |
| 6,800,811 | B1 | 10/2004 | Boucino et al. | |
| 6,812,408 | B2 | 11/2004 | Clark et al. | |
| 6,818,832 | B2 | 11/2004 | Hopkinson et al. | |
| 6,888,070 | B1 | 5/2005 | Prescott | |
| 2002/0050394 | A1 | 5/2002 | Clark et al. | |
| 2004/0050578 | A1 | 3/2004 | Hudson | |
| 2005/0092515 | A1 | 5/2005 | Kenny et al. | |
| 2005/0133246 | A1 | 6/2005 | Parker et al. | |
| 2006/0032660 | A1 | 2/2006 | Parke et al. | |
| 2006/0131058 | A1 * | 6/2006 | Lique et al. | 174/113 R |
| 2006/0243477 | A1 * | 11/2006 | Jean et al. | 174/113 R |

FOREIGN PATENT DOCUMENTS

| | | | |
|---|---|---|---|
| DE | 697378 | | 10/1940 |
| DE | 90 11 484.1 | U1 | 11/1990 |
| DE | 43 36 230 | C1 | 3/1995 |
| EP | 0961296 | | 12/1999 |
| EP | 1 087 410 | A2 | 9/2000 |
| EP | 1085530 | A2 | 3/2001 |
| EP | 1162632 | A2 | 12/2001 |
| EP | 1548754 | A2 | 6/2005 |
| EP | 1130604 | A2 | 9/2005 |
| FR | 2706068 | | 12/1994 |
| GB | 342606 | | 2/1931 |
| GB | 725624 | | 3/1955 |
| GB | 2260216 | A | 4/1993 |
| WO | 9848430 | | 10/1998 |
| WO | 0051142 | | 8/2000 |
| WO | 0154142 | | 7/2001 |
| WO | 0193281 | | 12/2001 |
| WO | WO 03077265 | A | 9/2003 |
| WO | 2005041219 | | 5/2005 |

* cited by examiner

TWISTED PAIR CABLE HAVING IMPROVED CROSSTALK ISOLATION

RELATED APPLICATIONS

This application claims priority under 35 U.S.C. §119(e) to U.S. Provisional Application Ser. No. 60/749,179, entitled "TWISTED PAIR CABLE HAVING IMPROVED CROSSTALK ISOLATION," filed on Dec. 9, 2005, which is herein incorporated by reference in its entirety.

BACKGROUND OF INVENTION

1. Field of Invention

This application is Application directed to a high speed data cable configured to improve alien crosstalk isolation between adjacent cables and/or improved crosstalk between twisted pairs of a cable.

2. Discussion of Related Art

High-speed data communications media include pairs of wire twisted together to form a balanced transmission line. Such pairs of wire are referred to as twisted pairs. One common type of conventional cable for high-speed data communications includes multiple twisted pairs that may be bundled and twisted (cabled) together to form the cable. There are two general categories of twisted pair cables: unshielded twisted pair (UTP) cables and shielded twisted pair (STP) cables, each of which has advantages and disadvantages. For some applications, the preferable cabling structure is "unshielded twisted pair" (UTP) cabling, meaning that the individual twisted pairs making up the cable do not have individual shielding layers. UTP is often preferred over shielded cables (and over optical fiber cables) because it is easier to install and more cost-effective.

Modern communication cables must meet electrical performance characteristics required for transmission at high frequencies. The Telecommunications Industry Association and the Electronics Industry Association (TIA/EIA) have developed standards which specify specific categories of performance for cable impedance, attenuation, skew and crosstalk isolation. When twisted pairs are closely placed, such as in a cable, electrical energy may be transferred from one pair of a cable to another. Such energy transferred between pairs is referred to as crosstalk and is generally undesirable. When two or more cables are stacked close together, or bundled together in a common outer sheath, an additional problem of crosstalk between twisted pairs in adjacent cables can occur. This is known as "alien" crosstalk. The TIA/EIA has defined standards for crosstalk, including TIA/EIA-568A. The International Electrotechnical Commission (IEC) has also defined standards for data communication cable crosstalk, including ISO/IEC 11801. One high-performance standard for 100Ω cable is ISO/IEC 11801, Category 5e, another is ISO/IEC 11801 Category 6.

Ethernet is now the most widely used network protocol in the world and there is an ever-increasing need in the industry for cables capable of reliable Ethernet data transmission at higher and higher transmission rates. A few years ago, transmission rates of a few Megabits per second (Mbps) were considered the state of art. However, transmission rates of more than ten Gigabits per second (Gbps) are now expected. The higher the desired transmission rate of data through a cable, the more critical becomes controlling effects such as crosstalk, skew and attenuation. Accordingly, a new 10 Gbps Ethernet over UTP standard for enhanced category 6 cables is being developed. One critical factor that needs to be addressed in the design of enhanced category 6 cables cable of 10 Gbps transmission rates is alien crosstalk. Alien crosstalk coupling, from the outside of the cable into the twisted pairs, is statistical and cannot be compensated for by adaptive amplifier techniques. Therefore, it is important to address alien crosstalk in the design of the cable itself.

To further reduce crosstalk between twisted pairs within a cable, some cables include a pair separator disposed between the twisted pairs to shield and/or isolate the twisted pairs from one another. For example, U.S. Pat. No. 6,222,130 describes a cable that includes four twisted pair media radially disposed about a "star"-shaped core. Each twisted pair nests between two fins of the "star"-shaped core, being separated from adjacent twisted pairs by the core. This helps reduce and stabilize crosstalk between the twisted pair media.

Some effort has been made in the prior art to reduce the effect of alien cross-talk on signal pairs in data cables. For example, some data communication cables include outer jackets having irregular or asymmetrical structures, as shown in FIG. 1. FIG. 1 depicts a communication cable including a plurality of twisted pairs 102 of insulated conductors surrounded by a cable jacket 100. The "dog-bone shaped" configuration of the cable jacket 100 shown in FIG. 1 increases the center-to-center distance between identical twisted pairs similarly positioned in the neighboring cables when stacked in alignment. The shaped outer jacket 100 may also achieve a misalignment by shape-induced sideways shifting of one cable relative to another, thereby preventing the possibility of positioning twisted pairs of the same twist lay very close together.

The shape of cable jacket 100 prevents symmetric stacking of flat data communication cables, when such cables are installed in ducts, troughs, and locations close to the cross-connect panels. Otherwise, the flat cables may automatically arrange, align and stack themselves in near perfect alignment due to their flat or rectangular shape. Such arrangement or flat cables increases alien cross-talk because the location of the twisted pairs within a flat cable jacket is parallel and the twisted pairs with the same twist lays or directions would be frequently separated only by the jacket material surrounding each cable.

However, a drawback to the shaped-jacket method of controlling alien crosstalk is that it is not always convenient or desirable to manufacture cables with irregularly-shaped outer jackets such as the cable jacket shown in FIG. 1. Therefore, a need exists for a mechanism to reduce alien crosstalk between adjacent cables that may have similar or identical twist lay configurations, while retaining a fairly conventional, easy to manufacture, outer jacket shape. Ideally, this mechanism would be appropriate for UTP cabling.

SUMMARY OF INVENTION

Aspects and embodiments of the present invention are directed to a separator structure that acts to reduce alien crosstalk between similar twisted pairs in cables that are in close proximity to one another.

According to one embodiment, a high speed data cable comprises a first twisted pair of insulated conductors, a second twisted pair of insulated conductors, and a separator positioned so as to separate the first twisted pair from the second twisted pair. The cable also comprises a jacket disposed about the first and second twisted pairs and the separator. According to one aspect, the separator comprises a central arm and at least one enlarged portion positioned at one end of the central arm and positioned at least partially around the first twisted pair of insulated conductors so as to create an outward projection of the jacket.

According to another embodiment, a high speed data cable comprises a first twisted pair of insulated conductors, a second twisted pair of insulated conductors, and a separator positioned so as to separate the first twisted pair from the second twisted pair. The cable also comprises a jacket disposed about the first and second twisted pairs and the separator. According to one aspect, the separator comprises a central arm and substantially symmetrical enlarged portions positioned at opposing ends of the central arm.

According to another embodiment, a cable comprises a first twisted pair of insulated conductors, a second twisted pair of insulated conductors, a separator positioned so as to separate the first twisted pair from the second twisted pair, and a jacket disposed about the first and second twisted pairs and the separator, wherein the separator comprises a central arm and symmetrical enlarged portions positioned at opposing ends of the central arm. In one example, the separator comprises a first ball formed on a first end of the central arm, and a second ball formed on a second, opposite end of the central arm, and wherein the first and second enlarged portions are similarly sized and equidistant from a center of the central arm.

According to one embodiment, a high speed data cable comprises a plurality of twisted pairs of insulated conductors including a first twisted pair, a second twisted pair and a third twisted pair, a shaped filler including a body portion and a plurality of tines extending outward from the body portion, the plurality of tines defining a plurality of channels in which the plurality of twisted pairs of insulated conductors are individually disposed, and an outer jacket surrounding the plurality of twisted pairs of insulated conductors and the shaped filler along a length of the cable. The shaped filler is constructed such that the body portion provides a first spacing between the first twisted pair and the second twisted pair and one of the plurality of tines provides a second spacing between the second twisted pair and the third twisted pair, the second spacing being substantially smaller than the first spacing. According to aspects of this embodiment of the invention, the body portion is constructed so as to provide a helical circumferential barrier extending along a length of the cable to facilitate reduction of alien crosstalk.

According to another embodiment, a high speed data cable comprises a first twisted pair of insulated conductors, a second twisted pair of insulated conductors, a third twisted pair of insulated conductors, a fourth twisted pair of insulated conductors, and a jacket disposed about the first, second, third, and fourth twisted pairs of insulated conductors. According to this embodiment, the first twisted pair, the second twisted pair, the third twisted pair and the fourth twist pair make up a core of the cable, and the core is helically wrapped with a dielectric rod.

According to another embodiment, a high speed data cable comprises a first twisted pair of insulated conductors, a second twisted pair of insulated conductors, a third twisted pair of insulated conductors, a fourth twisted pair of insulated conductors, and a jacket disposed about the first, second, third, and fourth twisted pairs of insulated conductors. According to this embodiment, the first twisted pair, the second twisted pair, the third twisted pair and the fourth twist pair make up a core of the cable, and the core is oscillated about the center of the cable within the jacket.

According to another embodiment, a high speed data cable comprises a first twisted pair of insulated conductors, a second twisted pair of insulated conductors, a third twisted pair of insulated conductors, a fourth twisted pair of insulated conductors, and a jacket disposed about the first, second, third, and fourth twisted pairs of insulated conductors. According to this embodiment, the first twisted pair, the second twisted pair, the third twisted pair and the fourth twist pair make up a core of the cable, and the jacket is extruded along the length of the cable with substantially the same thickness and with varying tightness to the core of the cable.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
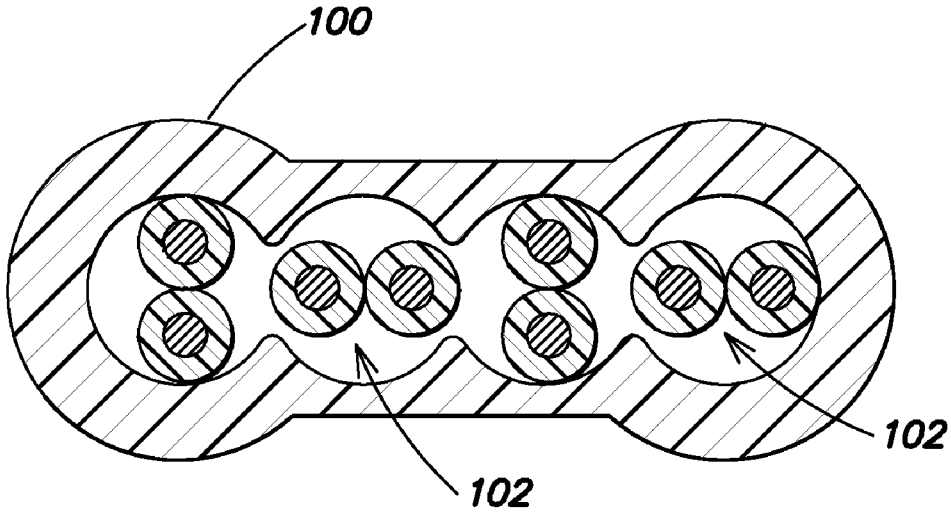
FIG. 1 (Prior Art)
FIG. 1 is a cross-sectional diagram of a prior art cable having a bone shaped cable jacket.

Various embodiments and aspects of the invention will now be described in detail with reference to the accompanying figures. It is to be appreciated that this invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of the words "including," "comprising," "having," "containing," or "involving," and variations thereof herein, is meant to encompass the items listed thereafter and equivalents thereof as well as additional items.

Some aspects and embodiments of the present invention are directed to a twisted pair cable including a shaped filler that defines channels in which the twisted pairs are located. The shaped filler holds the twisted pairs in a predefined relationship with one another, and may help to reduce crosstalk between twisted pairs and/or impedance non-uniformities. In addition, according to other aspects of the invention, the shaped filler may cause the cable to have a non-uniform outer circumference, resulting in non-equidistant spacing between adjacent cables, as discussed further below.

Other aspects and embodiments of the present invention are directed to a twisted pair cable including filler that provides for non-equidistant spacing between twisted pairs in adjacent cables and reduced alien crosstalk between adjacent cables, as discussed further below.

Other aspects and embodiments of the present invention are directed to a twisted pair cable including a dielectric rod about a circumference of the cable that provides for non-equidistant spacing between twisted pairs in adjacent cables and reduced alien crosstalk between adjacent cables, as discussed further below.

Other aspects and embodiments of the present invention are directed to a twisted pair cable including core that is spiraled about the center of the cable within a jacket of the cable that provides for non-equidistant spacing between twisted pairs in adjacent cables and reduced alien crosstalk between adjacent cables, as discussed further below.

Other aspects and embodiments of the present invention are directed to a twisted pair cable including a jacket that provides for varying regions of tightness of the jacket about a core of the cable and that provides for non-equidistant spacing between twisted pairs in adjacent cables and reduced alien crosstalk between adjacent cables, as discussed further below.

Cables according to various embodiments of the present invention may be used in all cable applications, including but not limited to, data or voice network applications (e.g., cables connecting computers, telephones or other data network components), local area networks (LANs), Ethernet applications, and a variety of other cable applications.

Aspects of the present invention relate to an unshielded twisted pair (UTP) cable capable of meeting the requirements for 10 Gigabit per second (Gbps) data transmission rates. Embodiments of the invention include a UTP cable comprising a separator that lies between twisted pairs in the cable and is designed to reduce alien crosstalk effects from nearby or adjacent cables.

As discussed above, crosstalk between twisted pairs in a twisted pair data cable, and alien crosstalk between twisted pairs in co-located cables are of particular concern to designers of high performance, high speed data cables. The present invention offers solutions to the problems of crosstalk and alien crosstalk through the use of novel shaped fillers.

Figure 2:
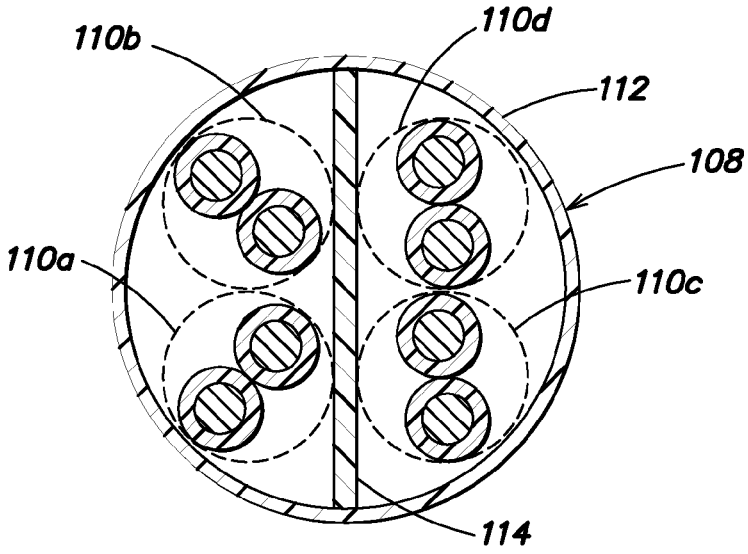
FIG. 2 (Prior Art)
FIG. 2 is a cross-sectional diagram of a prior art twisted pair cable including a separator.

Referring to FIG. 2, there is illustrated one embodiment of a conventional cable 108 comprising a plurality of twisted pairs 110*a*, 110*b*, 110*c*, 110*d* surrounded by an outer jacket 112. The cable 108 also includes a separator 114 that is positioned between the plurality of twisted pairs 110 so as to separator some of the twisted pairs 110 from others of the twisted pairs 110. The separator 114 runs along a longitudinal length of the cable and serves to reduce crosstalk between twisted pairs by providing desired spacing between the twisted pairs. For example, twisted pair 110*a* may have a twist lay that is similar to the twist lay of twisted pair 110*c* and the separator 114 may be positioned so as to separate twisted pair 110*a* from twisted pair 110*c* thereby reducing crosstalk that may otherwise occur between the two twisted pairs.

Separators present in conventional cables may have numerous different shapes and may be folded and arranged within the outer jacket so as to separate one or more twisted pairs from other twisted pairs in the cable. For example, U.S. Pat. No. 6,570,095 to Clark et al discloses several arrangements of tape separators. Other separators may be, for example, star-shaped, such as the separator disclosed in U.S. Pat. No. 6,222,130 to Gareis, or cross-shaped, such as the separator disclosed in U.S. Pat. No. 5,969,295 to Boucino et al. These separators, regardless of shape or material, are generally used to prevent physical contact between opposite and adjacent twisted pairs, and the primary function of these separators is to reduce crosstalk between twisted pairs within a cable. However, such separators may have little or no effect on alien crosstalk between twisted pairs in neighboring cables.

Figure 3:
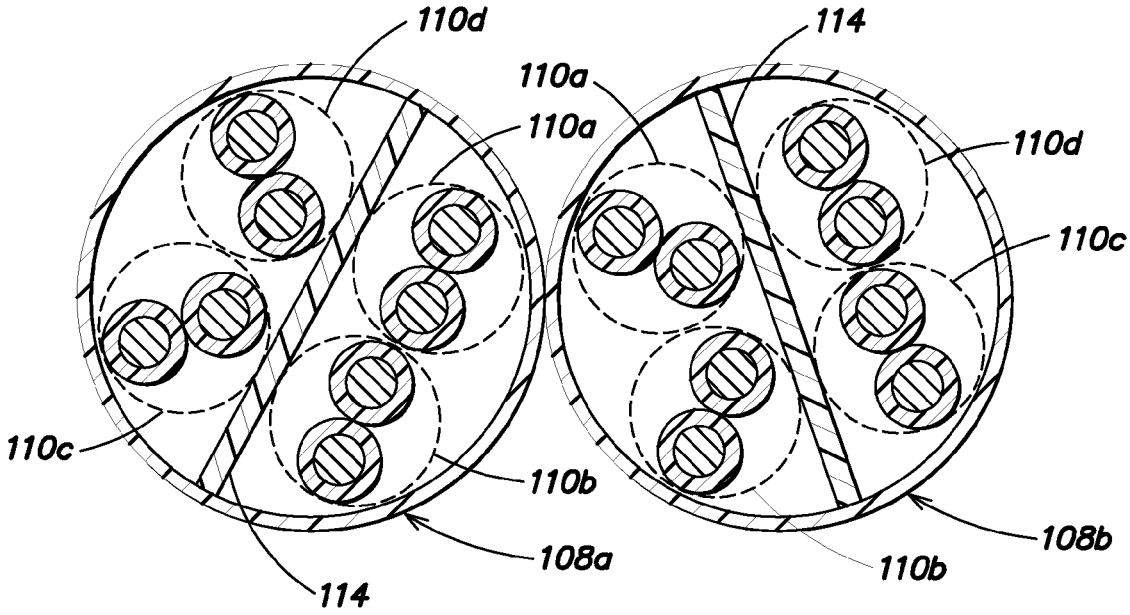
FIG. 3 (Prior Art)
FIG. 3 is a cross-sectional diagram of a two prior art twisted pair cables lying adjacent one another.

In many circumstances, cables may be bundled together or may be placed in close proximity, for example, inside a conduit. As discussed above, alien crosstalk among such cables in close proximity is an important concern in the design of high speed data cables. Referring to FIG. 3, there is illustrated in cross-section two cables 108*a*, 108*b* lying adjacent one another. Each cable 108*a*, 108*b* may comprise a plurality of twisted pairs 110*a*, 110*b*, 110*c*, 110*d* having different twist lays, and a separator 114, for example, any of the separator types discussed above.

As shown in FIG. 3, in some circumstances, the orientation of the cables 108*a*, 108*b* may be such that two twisted pairs 110*a* having similar twist lays in different cables are positioned is close proximity with one another, which may result in significant alien crosstalk between the two pairs. It is to be appreciated that this may occur in a variety of circumstances. For example, twisted pair 110*a* in cable 108*b* may have an identical twist lay to twisted pair 110*a* in cable 108*a*, or may have a slightly different twist lay. In addition, in some circumstances, it may be that another twisted pair, for example, twisted pair 110*c* in cable 108*b*, may have a twist lay similar to the twist lay of twisted pair 110*a* in cable 108*a*, and may lie in close proximity to twisted pair 110*a* in cable 108*a*. As evident from FIG. 3, the separators 114 have no effect on the proximity of these twisted pairs (e.g., pairs 110*a* in each cable as shown) and thus do not provide any reduction in alien crosstalk.

In the above and similar circumstances, alien crosstalk can occur between two closely spaced twisted pairs in adjacent cables when the two closely spaced twisted pairs have similar twist lays. For example, two cables may be manufactured, each comprising four twisted pairs of insulated conductors, the twisted pairs having twist lays approximately as shown in Table 1.

TABLE 1

| Twisted Pair | Twist Lay (Inches) |
|---|---|
| 110a | 0.504 |
| 110b | 0.744 |
| 110c | 0.543 |
| 110d | 0.898 |

It is to be appreciated that the twist lays given in Table 1 are exemplary only and not intended to be limiting. It is also to be appreciated that, due to manufacturing tolerances, the actual twist lays of the individual twisted pairs in different cables may be slightly different that the exemplary values given in Table 1. However, alien crosstalk can occur not only between twisted pairs with identical twist pays, but also between twisted pairs with similar twist lays. Therefore, as can be seen from Table 1 and FIG. 3, significant alien crosstalk may occur in a number of circumstances, for example, when cables are positioned such that pair 110*a* of one cable is near either pair 110*a* or 110*c* of another cable. Similarly, significant alien crosstalk may occur when twisted pair 110*b* of one cable lies near to either twisted pair 110*b* or twisted pair 110*d* of another cable. Thus instances of cable positioning where alien crosstalk between closely spaced twisted pairs may be problematic are not rare. As discussed above, in order for a UTP cable to meet transmission specifications for gigabit Ethernet data transmission, there is a need to reduce alien crosstalk occurring between such twisted pairs.

Figure 4:
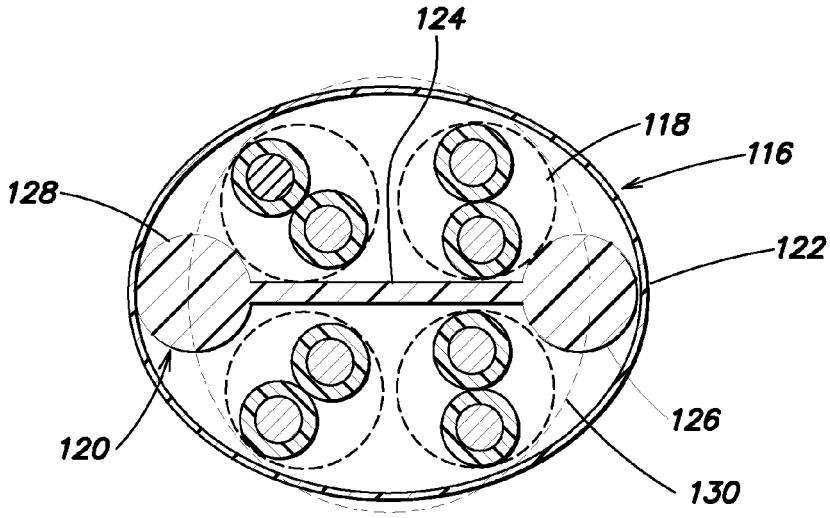
FIG. 4 is a cross-sectional diagram of a twisted pair cable including a separator according to aspects of the invention.

According to one embodiment, there is provided a separator that may be positioned between twisted pairs in a cable and that serves to reduce alien crosstalk between similar twisted pairs in adjacent cables. Referring to FIG. 4, there is illustrated one example such a separator positioned in a twisted pair cable. In this embodiment, the cable 116 comprises a plurality of twisted pairs of insulated conductors 118 and a separator 120 surrounded by a cable jacket 122. The separator 120 may comprise a central portion or arm 124 and two enlarged (relative to the arm) portions 126, 128 positioned on either end of the arm 124, such that the separator 120 has a "dumbbell" shape, as shown. For the purposes of clarity and conciseness, the enlarged portions 126, 128 are referred to herein as "enlarged portions." However, it is to be appreciated that the term "enlarged portions" is simply used for identification and is not intended to imply that the enlarged portions be any particular shape. The enlarged portions 126, 128 may have a number of different shapes, for example, may be oblong, rectangular, hexagonal, polygonal or any of a variety of other shapes, and are not limited to being circular or approximately circular. In one embodiment as illustrated in FIG. 4, the enlarged portions may be formed at opposite ends of the central arm 124, as shown, and may be equidistant from a center of the central arm. In addition, as will be discussed herein, the separator may include symmetrical enlarged portions at both ends of at least one central arm portion, asymmetrical enlarged portions at both ends of at least one central arm portion, or an enlarged portion disposed at least one end of a central arm portion. In addition, as will be discussed herein various embodiments of a separator may have more than one central arm portion, with each additional central arm portion having any of: no enlarged portions, an enlarged portion disposed at least one end of a central arm portion, symmetrical enlarged portions at both ends of at least one additional central arm portion, and asymmetrical enlarged portions at both ends of at least one additional central arm portion.

In addition, it is also to be appreciated that the cable may comprise any number of twisted pairs (not limited to four pairs as illustrated) and the twisted pairs 118 may be positioned about the separator 120 in any desired configuration (not limited to the illustrated example of two pairs on either side of the separator).

As shown in FIG. 4, when the twisted pairs 118 and the separator are cabled (twisted) together to form the cable 116, the enlarged portions 126, 128 of the separator cause the overall shape of the cable to become oval, rather than the conventional round shape (illustrated in FIG. 4 by dotted line 130). This effect is caused by the presence of the relatively large bulk of the enlarged portions on opposite sides of the cable which cause the jacket to take on an oval shape to accommodate their presence. According to one embodiment, the twisted pairs 118 are contained more toward a central region of the oval-shaped cable compared with a conventional round cable, as can be seen in FIG. 4. The enlarged portions of the separator extend outside the central region and into the oval edges of the cable. When the cable is helically twisted about its longitudinal axis (which occurs as part of the cabling procedure when the twisted pairs 118 and the separator 120 are cabled together and jacketed by jacket 122), the enlarged portions 126 and 128 form a helical wall or barrier around the circumference of the cable along its length, and thus around the twisted pairs 118, as shown in FIG. 5.

Figure 5:
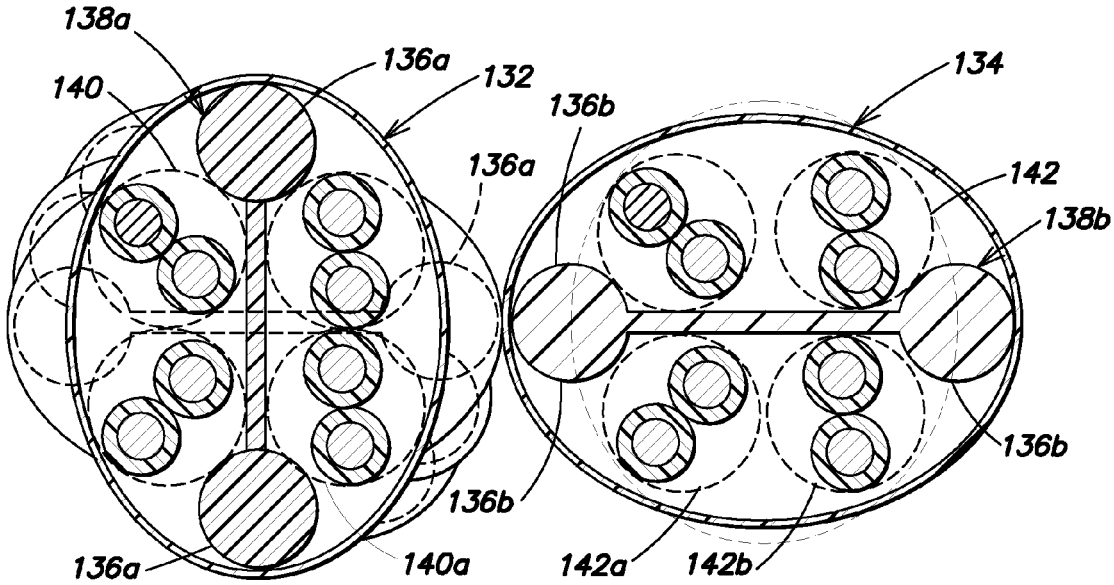
FIG. 5 is a diagram of two adjacently situated cables according to aspects of the invention.

Referring to FIG. 5, there are illustrated two cables of FIG. 4 lying adjacent one another. For the purposes of clarity and explanation, only one cable 132 is shown cabled whereas the other cable 134 is simply shown in cross-section. However, it is to be appreciated that in actuality, when two cables are lying close to one another in a conduit or other area, it is most likely that both will be cabled (i.e., each helically twisted about its internal longitudinal central axis in the same manner that the two insulated conductors making up a twisted pair are twisted about one another).

According to one embodiment, illustrated in FIG. 5, the enlarged portions 136*a* and 136*b* of the respective separators 138*a* and 138*b* in cables 132 and 134 respectively, abut one another, causing the twisted pairs 140 of the cable 132 to be spaced further apart from the twisted pairs 142 of cable 134, relative to a cable without a shaped separator such as, for example, a conventional round cable as shown in FIG. 3 (and as illustrated in phantom in FIG. 5 for cable 134). Considering the two cables 132 and 134 in cross-section alone, it is possible that the cables may be so oriented with respect to one another that the separators 138*a*, 138*b* are parallel with one another, such that the enlarged portions 136*a* and/or 136*b* do not lie between the twisted pairs 140 and 142, for example at various points along the length of the adjacently positioned cables. However, on aspect of the cable and separators of the invention as discussed above, is that when the cables 132 and 134 are cabled, the enlarged portions of the separators form a spiral barrier along the lengths of the cables, such that no matter the orientation of either cable at any given point along its length, the enlarged portions will be interposed between the two sets of twisted pairs of the two cables at various points along the cable length (e.g. every 360 degrees of rotation of the cable). The barrier formed by the enlarged portions 136*a*, 136*b* will always help separate the twisted pairs 140 from the twisted pairs 142. One example of an appropriate cable lay length for a four pair twisted pair cable may be approximately 2.5 inches. For such a cable lay, the enlarged portions will be interposed between the two cables at least every 2.5 inches. An advantage of the separators and cables of the invention is that alien crosstalk decreases as the distance between twisted pairs increases. Therefore, because the twisted pairs of the adjacent cables are spaced further apart from one another by the barrier produced by the separators, alien crosstalk between the pairs is reduced.

Referring to FIG. 3, two twisted pairs 110*a* can be in close proximity when the cables 108*a* and 108*b* are lying adjacent one another. By contrast, in cables having the separator 138*a*, 138*b* according to aspects of the invention, twisted pair 140 (in cable 132) and twisted pair 142 (in cable 134), which may have similar twist lays, are not in close proximity because the enlarged portions 136*a* and 136*b* of the separators 138*a* and 138*b*, respectively, prevent the twisted pairs 140*a* and 142*a* from coming close together, as shown in FIG. 5.

Figure 6:
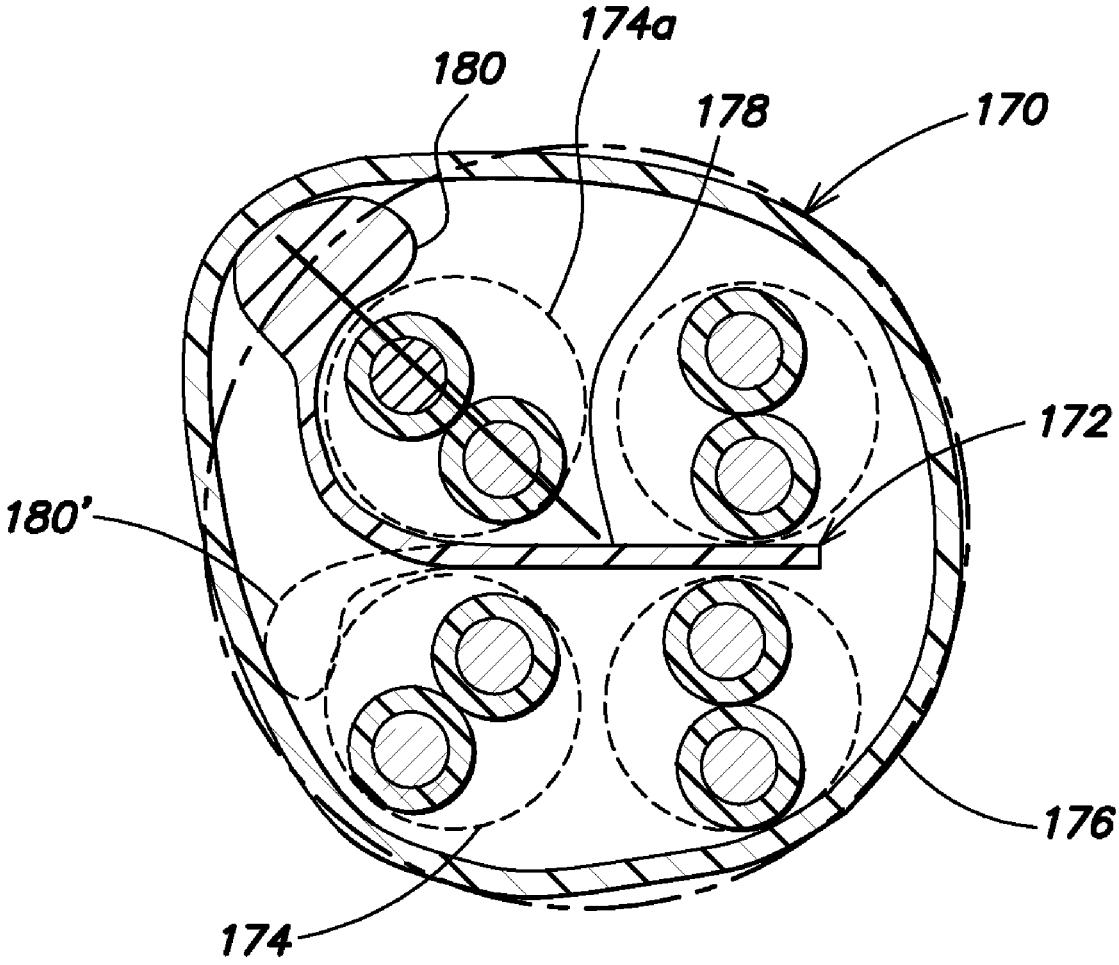
FIG. 6 is a cross-sectional diagram of another embodiment of a twisted pair cable including a separator according to aspects of the invention.

According to one embodiment of the invention, the separators 138*a*, 138*b* are provide with at least one enlarged portion 136*a*, 136*b*, which are disposed so that they are situated adjacent to the twisted pairs of conductors having the shortest twist lays (illustrated as 140*a*, and 142*a* in FIG. 5), and so as to separate the twisted pairs 140*a*, 142*a* having the shorter twist lays at various points along the cable 132, 134 lengths. In the illustrated embodiment with two enlarged portions 136*a*, 138*a* (cable 132) and 136*b*, 138*b* (cable 134), it is to be understood that since the twisted pairs 140, 142 are disposed in a short twist lay, long twist lay, short twist lay, long twist lay configuration, each of the enlarged portions will be disposed near a twisted pair having a short twist lay and a long twist lay. It should be appreciated that, however, for embodiments with a single enlarged portion as will be discussed in further detail herein, the enlarged portion need not be adjacent the twisted pair having the shortest or shorter twist lay lengths, however there are advantages to providing the enlarged portions adjacent the shortest or shorter twist lay length twisted pair. In particular, the shorter twist lay length pairs are typically insulated with a thicker insulation thickness and thus have an overall larger diameter than the twisted pairs with the longer twist lay lengths which typically have a thinner insulation thickness and thus a thinner overall diameter. So, according to some aspects an advantage to providing the enlarged portion adjacent (or around as illustrated in FIG. 6) the shortest or shorter twist lay length twisted pair will result in two cables being more physically separated along an axis perpendicular to the cable lengths, than if enlarged portion is provided around the twisted pair having a longer or longest lay length. Thus, providing the enlarged portion adjacent to or around the shortest twist lay length twisted pairs will provide the best alien crosstalk reduction.

Figure 20:
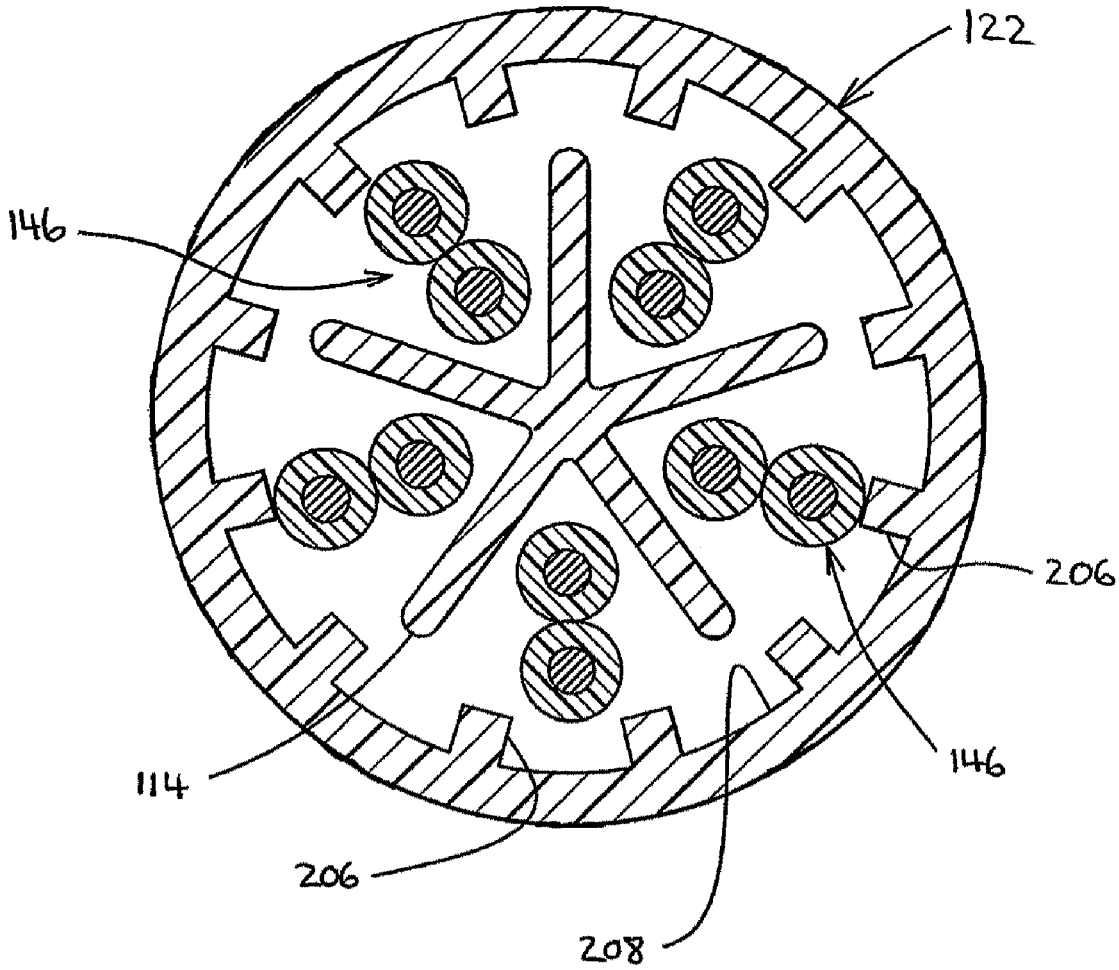
FIG. 20 is a cross-sectional diagram of one example of a cable including a jacket having internal striations according to another embodiment of the invention.

Thus, the separators 138*a*, 138*b* according to aspects of the invention may reduce alien crosstalk between similar twisted pairs in adjacently situated cables by increasing the spacing between such twisted pairs. Advantageously, according to some aspects of the invention, the separator may achieve a reduction in alien crosstalk without modification to the cable jacket. However, it is also to be appreciated that the jacket may be formed with a plurality of protrusions 206 extending away from an inner circumferential surface 208 of the jacket such as illustrated in FIG. 20 and disclosed in commonly owned U.S. Pat. No. 7,135,641 which is herein incorporated by reference, wherein the plurality of protrusions cause the plurality of twisted pairs of insulated conductors to be kept away from the inner circumferential surface of the jacket, and serve a similar purpose as the herein described embodiments of the separator.

It is to be appreciated that cables according to aspects of the invention can be constructed using a number of different materials for the twisted pair insulations, the separator and the cable jacket. For example, the separator according to aspects of the invention may comprise one or more of many different materials, conductive or non-conductive, flame retardant or not. For example, the separator may include a flame-retardant, low-dielectric constant, low-dissipation factor polymer, which may be foamed in some examples. In one example, the separator may comprise a foamed flame retardant, cellular polyolefin or fluoropolymer like NEPTC PP500 "Super-Bulk", a foamed fluorinated ethylene propylene (FEP) or a foamed polyvinyl chloride (PVC). For plenum-rated cables, the separator may include materials with flame retardant and/or smoke-suppressive properties or additives. The separator may also be constructed from a variety of other materials, including, but not limited to a bulk filling material such as a polyolefin or glass fiber filler, conductive materials, or partially conductive materials, such as a dielectric with a conductive coating or filling. In addition, the outer jacket 122 can be made from various materials including, for example, polyvinylchloride (PVC), low-smoke, low-flame PVC, or any plenum or non-plenum rated thermoplastic. Similarly, the twisted pairs may be insulated with any suitable insulation material, as known to those skilled in the art. It is to be appreciated that the above examples of materials are given as examples only and the invention is not limited to the use of these materials.

Further, as mentioned above, separators according to various aspects of the invention may have various different shapes and are not limited to the specific shape illustrated in FIGS. 4 and 5.

For example, referring to FIG. 6, there is illustrated another embodiment of a cable 170 comprising a separator 172 and a plurality of twisted pairs 174 cabled within a cable jacket 176. This embodiment of the separator comprises a central arm portion 178 and an oblong enlarged portion 180. According to some embodiments, the enlarged portion 180 is wrapped around a twisted pairs of conductors 174*a* so that if one were to draw a line from the center of central arm 178 through the center of twisted pairs 174*a* it would bisect the enlarged portion 180. It is to be appreciated that the enlarged portion can be provided in the cable in this configuration according to any method of manufacture known to those of skill in the art, including holding the artifact in place, for example, with a fine thread or tape, or during extrusion of the jacket around the cable. As has been discussed herein, the enlarged portion can be any shape, such as circular, oblong, tear-drop shaped, rectangular, hexagonal, polygonal, or any other shape. It is to also be appreciated that the enlarged portion does not have to wrap around the twisted pair 174*a* as illustrated in FIG. 6, and instead can be adjacent the twisted pair such as illustrated by enlarged portion 180∝ (shown in phantom). In addition, as has been discussed above, it is to be understood that the separator may include symmetrical enlarged portions at both ends of at least one central arm portion, asymmetrical enlarged portions at both ends of at least one central arm portion, or at least one enlarged portion disposed at least one end of a central arm portion. In addition, as will be discussed herein various embodiments of a separator may have more than one central arm portion, with each additional central arm portion having any of: no enlarged portions, an enlarged portion disposed at least one end of a central arm portion, symmetrical enlarged portions at both ends of at least one additional central arm portion, and asymmetrical enlarged portions at both ends of at least one additional central arm portion.

Figure 12:
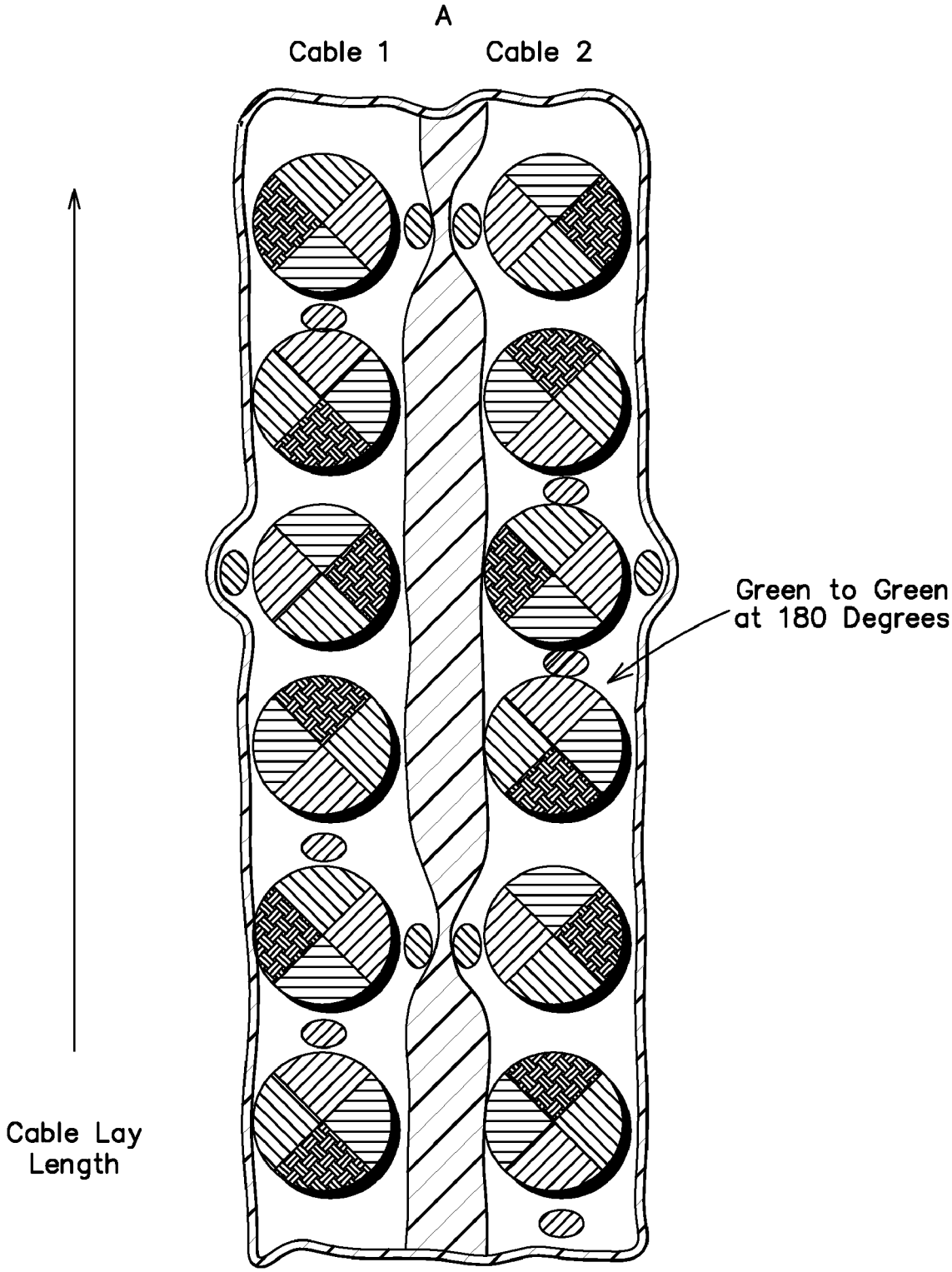
FIG. 12 is a diagram of one embodiment of two twisted pair cables including a separator that are laid together along their length, according to aspects of the invention.

In addition, it is also to be appreciated that the cable may comprise any number of twisted pairs (not limited to four pairs as illustrated) and the twisted pairs 174 may be positioned about the separator 172 in any desired configuration (not limited to the illustrated example of two pairs on either side of the separator as illustrated in FIG. 6). For example, in one embodiment, the enlarged portion 180 or 180' is situated adjacent (or around as illustrated in FIG. 6) the shortest or shorter twist lay length twisted pair 174*a*. With this arrangement, with two cables of the same separator construction and configured side-by-side (See FIG. 12 as discussed in further detail below), the enlarged portion 180 or 180' (illustrated as an oval in FIG. 12) will separate the twisted pairs of conductors, for example 174*a* having the shortest twist lay length, at various points along the length of the cables where the enlarged portions 180, 180' align between the cables, which results in two cables being more physically separated along an axis perpendicular to the cable lengths. In other words, the enlarged portions, when aligned as illustrated in FIG. 12, act as a separator or bridge between the cables providing physical separation between the cables along an axis that is perpendicular to the cables. It is to be understood also that according to various aspect of the invention, the enlarged portions 180, 180' need not be disposed adjacent the twisted pairs having the shortest or even the shorter twist lays, and can be disposed adjacent any of the twisted pairs.

As shown in the embodiment illustrated in FIG. 6, when the embodiment of the separator 172 and the twisted pairs 174 are cabled (twisted) together to form the cable 170, the enlarged portions 180, 180' of the separator causes the overall shape of the cable to be oblong, rather than the conventional round shape (illustrated in phantom by the dotted line). Thus, this embodiment of the cable on the invention also has the advantage of causing the twisted pairs 174 of adjacent cables to be spaced further apart relative to a cable with a separator having no enlarged portions (such as shown in FIG. 3), and therefore has the advantage of reducing alien crosstalk between twisted pairs of adjacently situated cables.

It is to be understood that there are two modes of alien crosstalk reduction between adjacently situated cables that can be achieved with the various embodiments of the invention described herein. As has been discussed above, FIG. 12 illustrates two cables according to the various embodiments of the invention, positioned side-by-side to illustrate how the various embodiments of the separator and cables of the invention provide spacing between the twisted pairs of the cables along an axis perpendicular to the cables. For the illustrated embodiment of the cable, which corresponds to the embodiment discussed above with respect to FIG. 6, the enlarged portion is illustrated in FIG. 12 as an oval next to a twisted pair of conductors as represented by a brown color quadrant (as indicated by the hashing symbol for brown) of the cable. In this embodiment, the oval is positioned adjacent the brown quadrant of the cable, which is intended to represent the twisted pair of conductors having the shortest twist lay. FIG. 12 illustrates that if two similarly constructed cables are disposed side-by-side and the enlarged portions of the cables align along the lengths of the cable, there will be numerous places along the lengths of the cables where the enlarged portions of the separator will align and will result in greater spacing between the twisted pairs of cables. In other words, the cables which are provide with a cable lay length and the enlarged portion of the separators provide a continuous spiral bridge along the length of the cables between the cables, and thus between the twisted pairs. For example, if the cable is provided with a 5" cable lay, then at substantially every 5" the enlarged portions of the separators of the cables will align to cause greater separation between the cables and between the twisted pairs.

Figure 13:
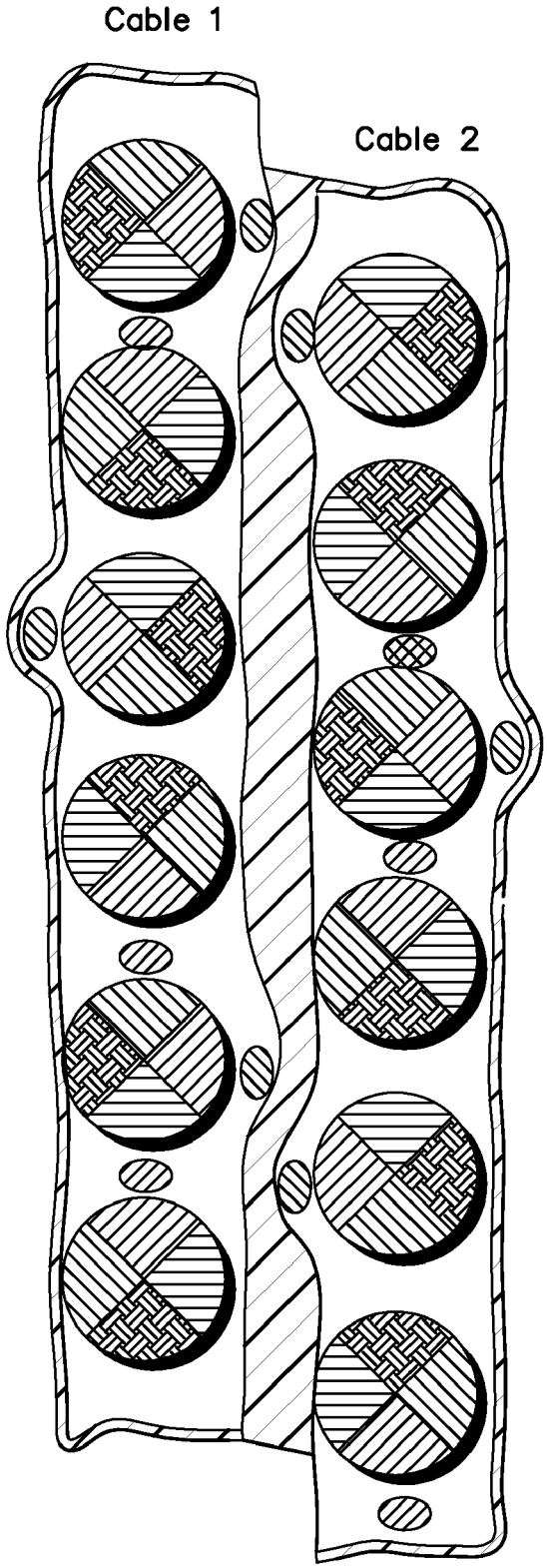
FIG. 13 is a diagram of one embodiment of two twisted pair cable including a separator that are laid together along their length to illustrate nesting of the cables, according to aspects of the invention.

FIG. 13 illustrates a second mode of spacing and isolation that is provided by the separators and cables of various embodiments of the invention. FIG. 13 illustrates two positioned side-by-side to illustrate how the various embodiments of the separator and cables of the invention can provide nesting between the cables along the lengths of the cables. FIG. 13 is also illustrated so that the enlarged portion of the separator is represented as an oval next to a twisted pair of conductors as represented by a color quadrant of the cable. In this embodiment, the oval is positioned adjacent the brown quadrant of the cable, which is intended to represent the twisted pair of conductors having the shortest twist lay. If one were to grasp and pull two similarly constructed cables according to the invention, such as the cable as illustrated in FIG. 6, the cables may tend to shift along their lengths with respect to each other and nest together as illustrated in FIG. 13. This shift between the two cables along the length of the cables has the added benefit of also reducing the pair to pair alignment between the cables thereby also resulting in increased distance between like pairs and overall reduced alien cross talk between the twisted pairs of the cables.

Figure 7:
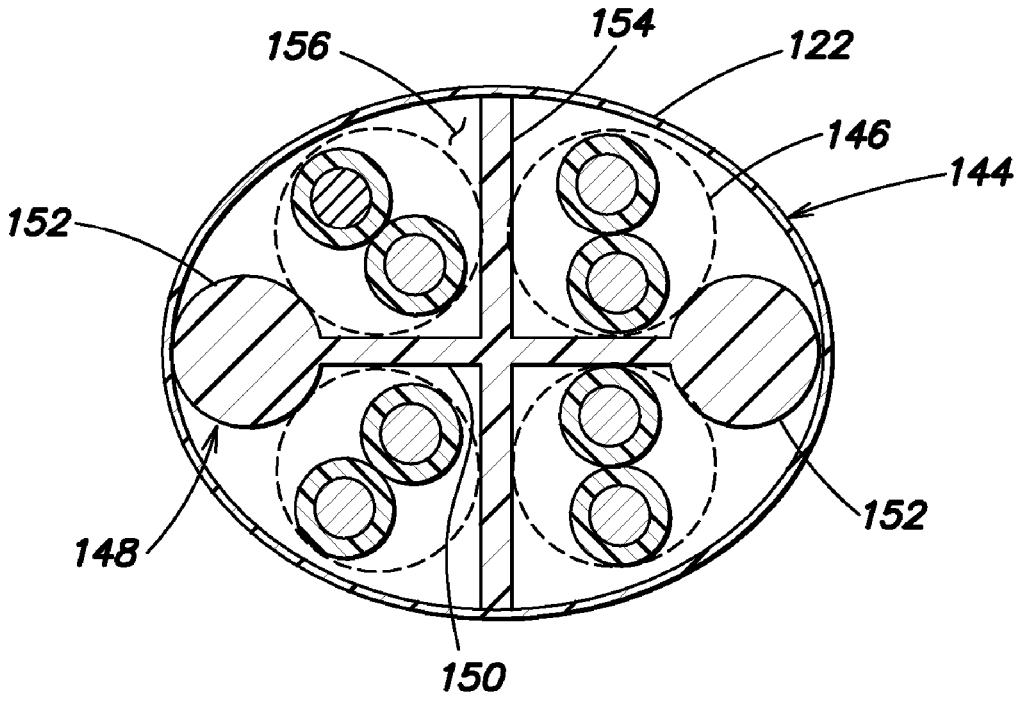
FIG. 7 is a cross-sectional diagram of another embodiment of a twisted pair cable including a separator according to aspects of the invention.
Figure 8:
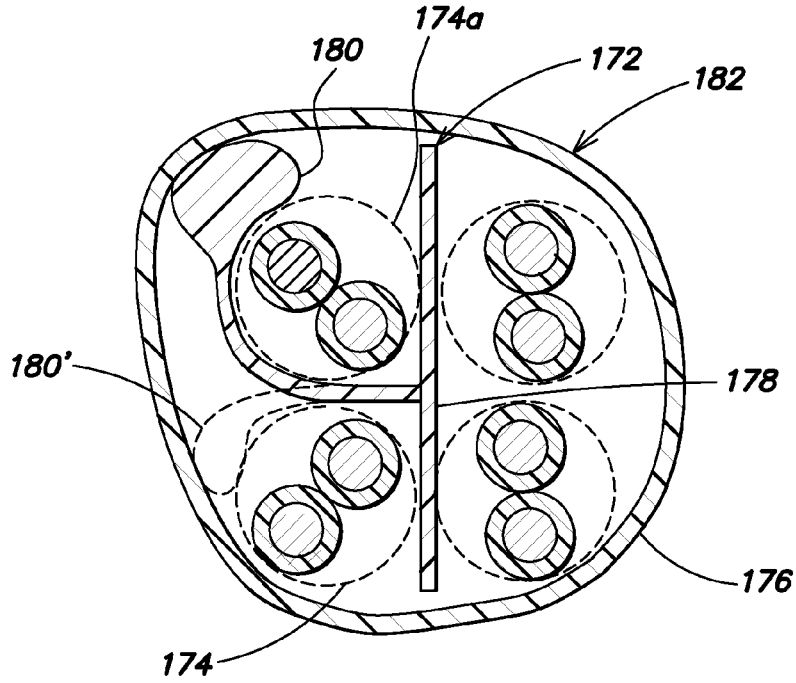
FIG. 8 is a cross-sectional diagram of another embodiment of a twisted pair cable including a separator according to aspects of the invention.
Figure 9:
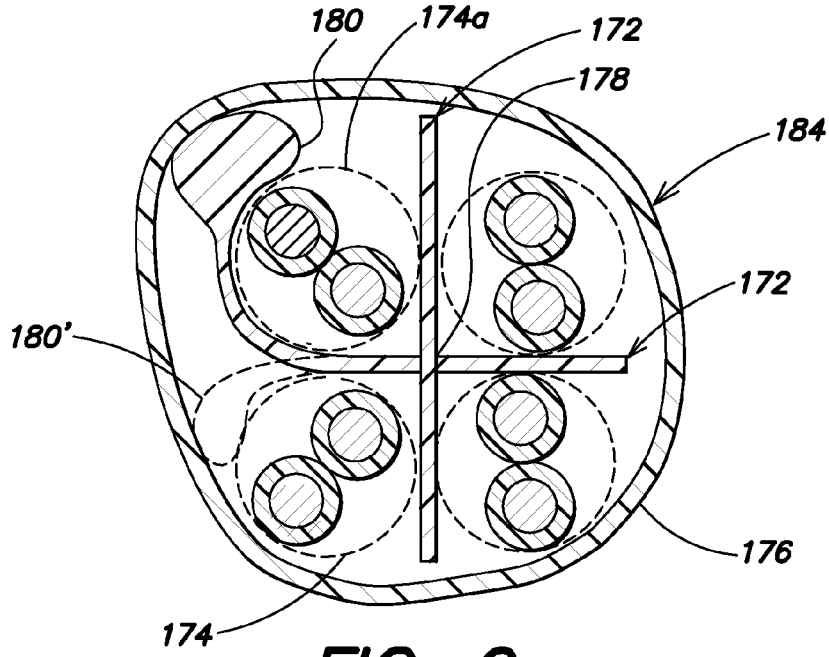
FIG. 9 is a cross-sectional diagram of another embodiment of a twisted pair cable including a separator according to aspects of the invention.
Figure 10:
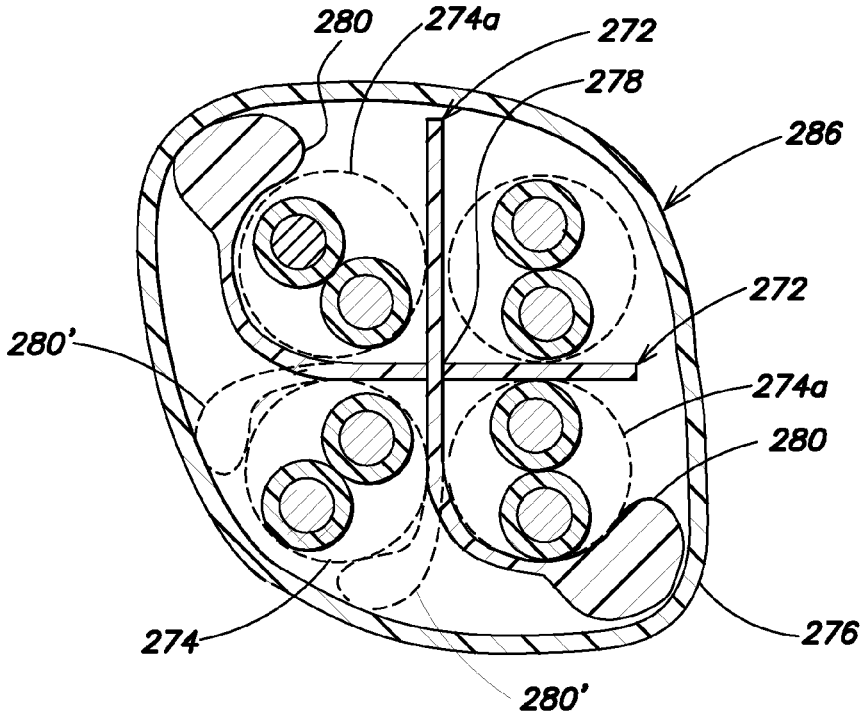
FIG. 10 is a cross-sectional diagram of another embodiment of a twisted pair cable including a separator according to aspects of the invention.
Figure 11:
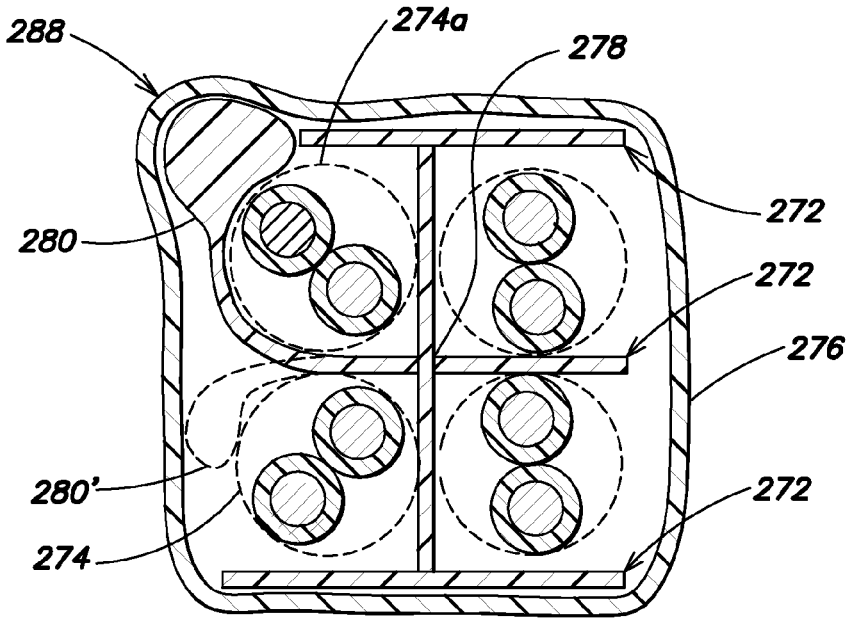
FIG. 11 is a cross-sectional diagram of another embodiment of a twisted pair cable including a separator according to aspects of the invention.

According to another embodiment as illustrated in FIG. 7, a cable 144 may include a plurality of twisted pairs 146 and a separator 148 which may have a central arm portion 150 and two enlarged portions 152 at either end of the central arm portion, and also an additional arm 154 portion. In the illustrated example in FIG. 7 the additional arm portion 154 is positioned at approximately 90 degrees to the central arm 150 such that the separator has a crossed-dumbbell shape. However it is to be appreciated that the invention is not so limited and the additional arm may be positioned not only in the approximate center of the central arm, but closer to one enlarged portion or the other enlarged portion, and may also be formed at any angle to the central arm. In addition, the separator 148 may include several other additional arms. For example, as will be discussed herein, various embodiments of a separator may have more than one central arm portion, with each additional central arm portion having any of: no enlarged portions, an enlarged portion disposed at least one end of a central arm portion, symmetrical enlarged portions at both ends of at least one additional central arm portion, and asymmetrical enlarged portions at both ends of at least one additional central arm portion. It is also to be understood that the enlarged portion can be any shape, such as circular, oblong, tear-drop shaped, rectangular, hexagonal, polygonal, or any other shape. It is also to be appreciated that the enlarged portion can be wrapped around a twisted pair like the enlarged portion 180 of FIG. 6, but need not be wrapped around the enlarged portion as illustrated, for example, by the enlarge portion 180' of FIG. 6. Thus, according to some embodiments of the invention, the separator 148 is useful not only for reducing alien crosstalk, but also for reducing crosstalk between twisted pairs within the cable 144. For example, in a four pair cable (as shown in FIG. 7), the two arm portions 150, 154 of the separator may provide four compartments 156 within which the twisted pairs 146 may be individually disposed. In another example, the cable 144 may include more than four twisted pairs 146 and more than one twisted pair may be disposed in any of the compartments 156. Furthermore, if the separator 148 includes additional arms, additional compartments may be provided within which twisted pairs may be located.

FIGS. 8-11 illustrate various embodiments 182, 184, 286, and 288 of cables that are provided with different embodiments of a separator according to the invention described herein, and which are provided as additional exemplary embodiments to illustrate some of the many alternative configurations that can be provided according to the invention. It is to be appreciated that these figures are illustrated with like reference numbers for like elements as discussed above, and that a description of each of the elements for each of the figures is not provided for the embodiments of FIGS. 8-11 for the sake of brevity.

It is to be appreciated that numerous shapes other than those illustrated are possible for the separators described herein, as may be apparent to those skilled in the art. For example, the separator may include enlarged portions that are not round, but instead have, for example, a squarish shape or any other of a multitude of shapes. The separator may also include numerous other arm portions, for example to separate twisted pairs within the cable when the cable comprises more than four twisted pairs. Furthermore, it is to be appreciated that according to any of the embodiments of the cables described herein, the jacket may be formed with a plurality of protrusions extending away from an inner circumferential surface of the jacket such as disclosed in commonly owned U.S. Pat. No. 7,135,641 which is herein incorporated by reference, wherein the plurality of protrusions cause the plurality of twisted pairs of insulated conductors to be kept away from the inner circumferential surface of the jacket, and serve a similar purpose as the herein described embodiments of the separator. It is to be understood that the invention is not limited to any specific shape of the separator. It is preferred that the separator provide at least one enlarged portion (of whatever shape) to create an oblong or oval or non-rounded shaped jacket, and in some embodiments that the separator contain the twisted pairs toward the center of the cable, as viewed when the cable is helically twisted (as in FIG. 5) and to provide increased spacing between twisted pairs of adjacent cables (as in FIG. 5) relative to conventional cables.

Figure 14:
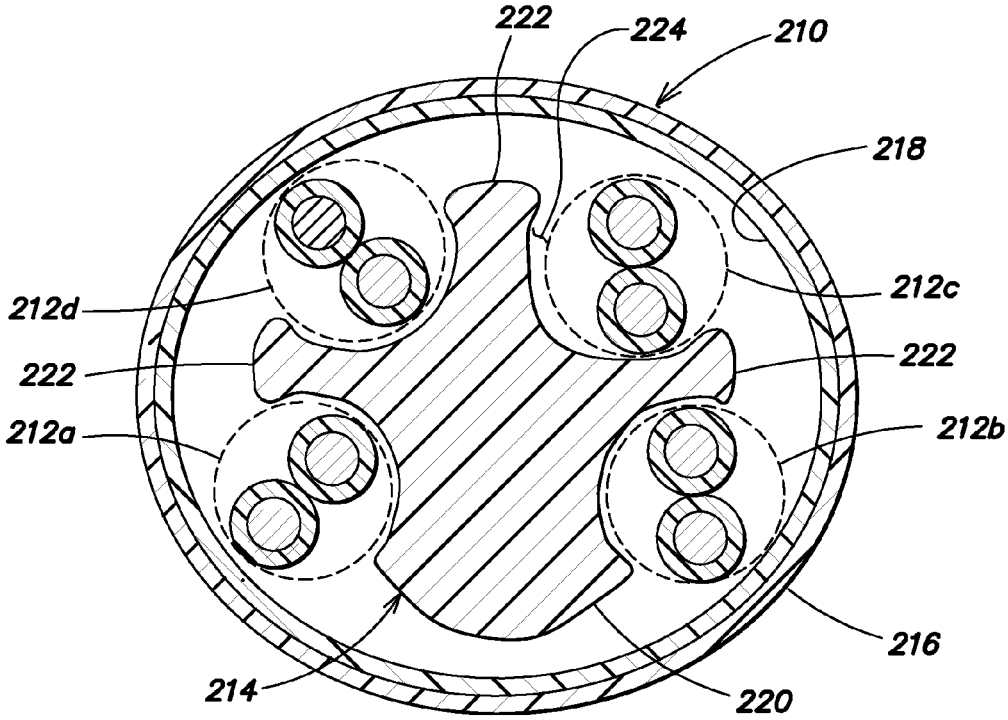
FIG. 14 is a cross-sectional view of a cable core including one embodiment of a filler according to one embodiment of the invention.

Referring to FIG. 14, there is illustrated one embodiment of a twisted pair cable including a shaped filler according to aspects of the invention. The cable 210 includes a plurality of twisted pairs of insulated conductors 212*a*, 212*b*, 212*c* and 212*d* disposed about a shaped filler 214. The filler 214 and the twisted pairs 212 comprise a cable core that may be surrounded by a jacket 216 and optionally a shield 218 disposed between the cable core and an interior surface of the jacket 216.

In one embodiment, the filler 214 includes a base portion 220 and a plurality of tines 222 that define channels 224 in which one or more twisted pairs 212 may be located. According to one preferred embodiment, each twisted pair 212 is individually located in a channel 224, such that each twisted pair is separated from other twisted pairs in the cable by a portion of the filler 214, e.g., by a tine 222 or by some of the base portion 220. Thus, the filer 214 serves to separate the twisted pairs from one another any may reduce crosstalk between the twisted pairs.

As discussed above, the twisted pairs 212 may have different twist lays from one another. For example, in one embodiment, the twisted pairs may have twist lays approximately as those shown below in Table 2.

TABLE 2

| Twisted Pair | Twist Lay (Inches) |
|---|---|
| 212a | 0.504 |
| 212b | 0.744 |

TABLE 2-continued

| Twisted Pair | Twist Lay (Inches) |
|---|---|
| 212c | 0.543 |
| 212d | 0.898 |

It is to be appreciated that the twist lays given in Table 2 are exemplary only and not intended to be limiting. It is also to be appreciated that, due to manufacturing tolerances, the actual twist lays of the individual twisted pairs in different cables may be slightly different that the exemplary values given in Table 2. However, crosstalk can occur not only between twisted pairs with identical twist pays, but also between twisted pairs with similar twist lays. Thus, in one example, the twisted pairs may be arranged about the filler 214 as shown in FIG. 14, such that twisted pairs with unlike twist lays (between which little or no crosstalk may occur), e.g., twisted pairs 212*a* and 212*d*, are separated only by a tine 222, whereas twisted pairs with similar twist lays, e.g., twisted pairs 212*a* and 212*c* are separated by a larger bulk of the filler 214. In this manner, the filler 214 may aid in reducing crosstalk between twisted pairs with similar twist lays.

Crosstalk between twisted pairs is inversely proportional to the distance separating the twisted pairs. Furthermore, crosstalk is diminished by the presence of a dielectric barrier material or conductive shield between twisted pairs. Therefore, by placing a large portion of the filler between twisted pairs, crosstalk between those twisted pairs is reduced because the pairs are spaced apart from one another and separated from one another by the filler. In addition, because a large portion of the filler may be disposed between twisted pairs with similar twist lays, a delta between the twist lays of two similar twisted pairs may be reduced without a negative impact on the crosstalk between those twisted pairs.

It is to be appreciated that the present invention is not limited to the embodiments illustrated in the figures. For example, the filler 214 is not limited to the shape illustrated in FIG. 14. The filler may have a variety of other shapes. For example, the base portion of the filler may have a more "bulbous" shape, a more rectangular shape, or any other shape that allows for a relatively large base portion. In addition, the cable may have more or fewer than four twisted pairs. Correspondingly, the filler 214 may have more or fewer tines than the three illustrated to provide a suitable number of channels 224 to accommodate the number of twisted pairs making up the cable. Furthermore, two or more twisted pairs may be disposed in a single channel, or some channels may be empty of a twisted pair. In addition, not all the tines 222 must be located on one side of the filler, as illustrated. Rather, some tines may be located extending from an opposite or adjacent surface of the base portion to other tines. Furthermore, it is to be appreciated that the jacket may be formed with a plurality of protrusions extending away from an inner circumferential surface of the jacket such as disclosed in commonly owned U.S. Pat. No. 7,135,641 which is herein incorporated by reference, wherein the plurality of protrusions cause the plurality of twisted pairs of insulated conductors to be kept away from the inner circumferential surface of the jacket, and serve a similar purpose as the herein described embodiments of the separator.

It is further to be appreciated that cables according to aspects of the invention can be constructed using a number of different materials for the twisted pair insulations, the filler and the cable jacket. For example, the filler according to aspects of the invention may comprise one or more of many different materials, and may be conductive or non-conductive, flame retardant or not. For example, the filler may include a flame-retardant, low-dielectric constant, low-dissipation factor polymer, which may be foamed in some examples. In one example, the separator may comprise a foamed flame retardant, cellular polyolefin or fluoropolymer like NEPTC PP500 "SuperBulk", a foamed fluorinated ethylene propylene (FEP) or a foamed polyvinyl chloride (PVC). For plenum-rated cables, the filler may include materials with flame retardant and/or smoke-suppressive properties or additives. The filler may also be constructed from a variety of other materials, including, but not limited to a bulk filling material such as a polyolefin or glass fiber filler, conductive materials, or partially conductive materials, such as a dielectric with a conductive coating or filling. In shielded twisted pair cables including the optional shield 218, it may be particularly advantageous to form the filler 214 of a conductive or partially conductive material. In addition, the outer jacket 222 can be made from various materials including, for example, polyvinylchloride (PVC), low-smoke, low-flame PVC, or any plenum or non-plenum rated thermoplastic. Similarly, the twisted pairs may be insulated with any suitable insulation material, as known to those skilled in the art. It is to be appreciated that the above examples of materials are given as examples only and the invention is not limited to the use of these materials.

Figure 15:
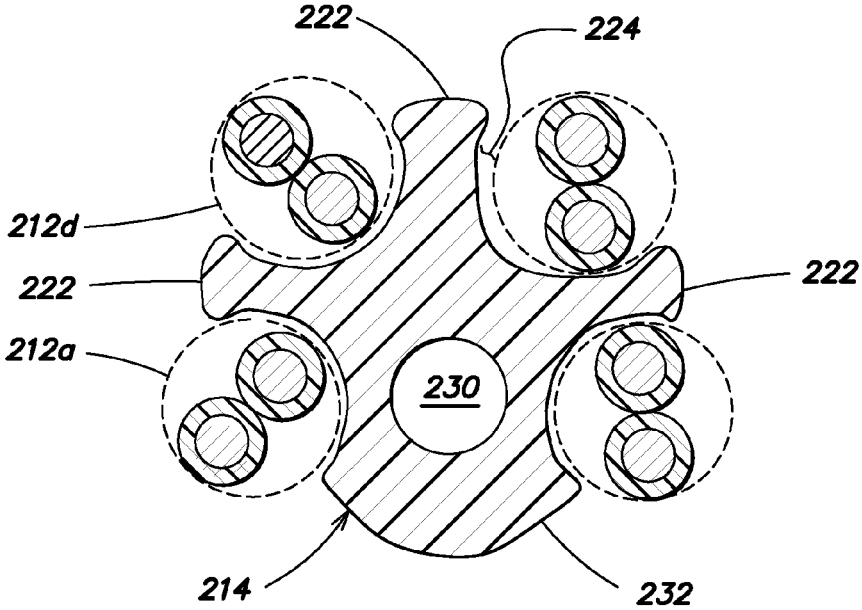
FIG. 15 is a cross-section view of another cable comprising a filler having an interior channel, according to aspects of the invention.

According to another embodiment, the filler 214 may be constructed so as to define an interior channel 230 in the base portion 232, as shown in FIG. 15. The interior channel 230 may provide a number of functions and purposes, including, but not limited to, the following. For example, the interior channel may be empty (or air-filled) thereby reducing the amount of material forming the filler. This may be advantageous in that it may reduce the cost of the filler and may also facilitate use of the cable for plenum-rated applications because the amount of potentially burnable or smoke-producing material making up the core is reduced by the presence of the interior channel. Reducing the amount of material used for the filler may also reduce the weight of the cable and/or improve flexibility of the cable. The interior channel may also provide a controlled or predefined air gap between the twisted pairs 212 which enhance performance parameters of the cable. In addition, the interior channel may carry one or more additional transmission media, such as optical fiber(s) or coaxial cable, which may transport data or power. In some examples, a drain wire or strength member may optionally be disposed within the interior channel. It is to be appreciated that the interior channel is not limited to being round, as illustrated, nor centrally disposed within the base portion of the filler.

Figure 16:
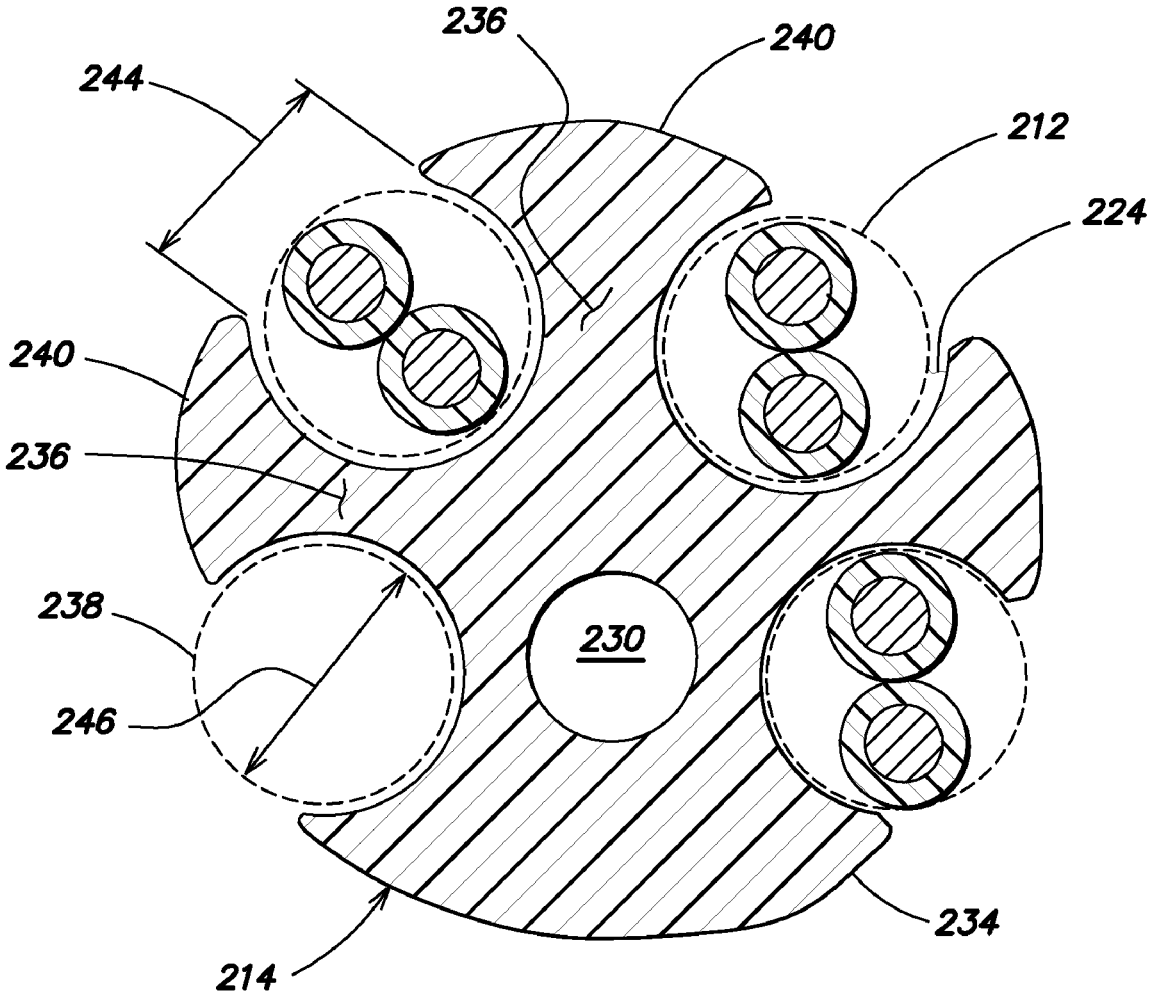
FIG. 16 is a cross-sectional view of another embodiment of a cable core including a filler according to aspects of the invention.

Referring to FIG. 16, there is illustrated another embodiment of a cable including a filler according to aspects of the invention. As discussed above, the cable 210 may comprise a plurality of twisted pairs of insulated conductors 212 disposed about a shaped filler 214. The filler 214 may include a body portion 234 and a plurality of tines 236 that define a corresponding plurality of channels 224 in which the twisted pairs 212 are individually disposed. In this embodiment, the tines 236 may be configured so as to extend away from the body portion 234 by a distance greater than or equal to an outer diameter of the space occupied by the twisted pair 212, illustrated by dotted line 238. In addition, each tine 236 may include flange portions 240 that extend toward the flange portions of adjacent tines, as illustrated in FIG. 16, thereby narrowing an opening of each channel 224.

In one example, the opening 244 of the channels 224 may be narrowed by the flange portions 240 of the tines 236 to slightly smaller than a diameter 246 of the circular space occupied by the twisted pairs 212. The material of the filler 214 may be slightly flexible so as to allow the twisted pairs to be "snapped" or pressed into the channels 224. The twisted pairs 212 are thus securely held in their respective channel 224 and may not be able to easily fall out of the channel when the cable is handled (for example, during installation or termination). This embodiment may offer an additional advantage in that the twisted pairs are securely held in a predetermined configuration, at controlled, defined spacing from one another, which may improve the impedance uniformity of the cable. In one example, the filler 214 may include an interior opening 230, as discussed above.

According to another embodiment, the shaped filler may be constructed such that when the cable core is cabled and when the jacket 216 is applied over the cable core, the filler 214 causes the outer circumference of the jacket to be non-uniform, e.g., non-circular. This effect may be achieved by controlling the shape of the body portion 220 of the filler and the location of the tines 222. A non-uniform outer circumference for the jacket 216 is advantageous in that it may prevent aligned stacking of multiple cables, which may serve to reduce alien crosstalk between twisted pairs in adjacent or nearby cables. In addition, when the cable is helically twisted about its longitudinal axis (which occurs as part of the cabling procedure when the twisted pairs and the separator are cabled together and jacketed), the body portion forms a helical wall or barrier around the circumference of the cable along its length. In other words, when the above-described embodiments of the filler is cabled with the twisted pairs of conductors and a jacket, the larger body part of the filler (220, 232, 234) provides for a larger portion that forms a helical barrier to alien crosstalk with adjacent cables along the length of the cable. Thus, it is to be appreciated that these embodiments of the filler also provide the reduced alien cross talk effect as the other herein described embodiments of the invention. It is also to be appreciated that the jacket for such embodiment may be formed with a plurality of protrusions extending away from an inner circumferential surface of the jacket such as disclosed in commonly owned U.S. Pat. No. 7,135,641 which is herein incorporated by reference, wherein the plurality of protrusions cause the plurality of twisted pairs of insulated conductors to be kept away from the inner circumferential surface of the jacket, and serve a similar purpose as the described embodiments of the separator.

Figure 19:
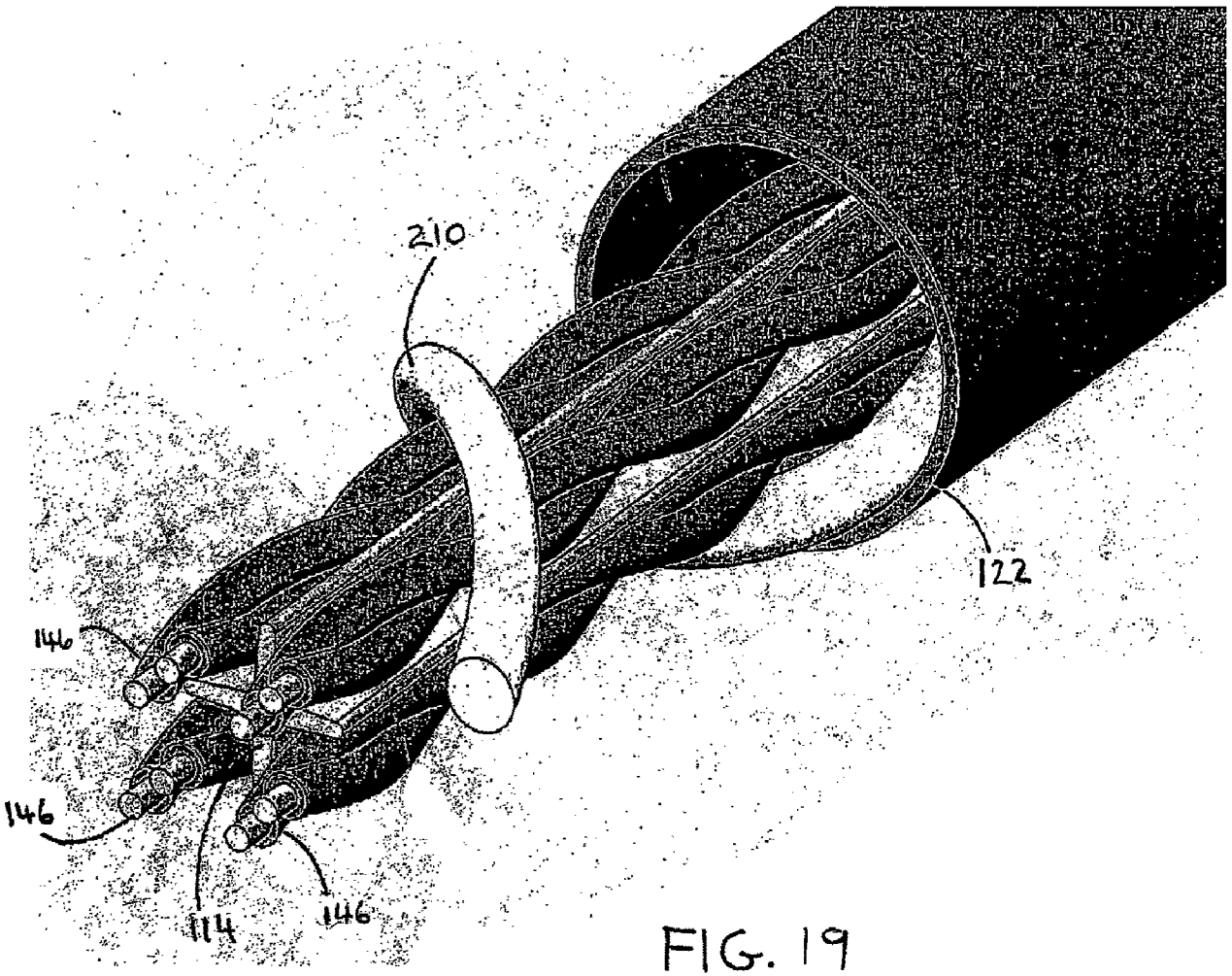
FIG. 19 is a perspective view of one embodiment of a cable including a dielectric rod helically wound around the cable core.

According to another embodiment of the invention, any of the herein described cables, whether previously known or those according to the invention, can be provided with at least one contra helically wrapped rod 210 about a circumference of the cable, as shown in FIG. 19. The rod can be any dielectric for an UTP cable (and could be metallic if cable includes a shield) that is wrapped around the core of the UTP cable. By core, it is understood that the core comprises the twisted pairs of conductors, any separator if one is provided in the cable, and an optional binder to keep the twisted pairs and any separator together. The at least one dielectric rod 210 is helically wrapped around the core, for example, in a clockwise direction to provide a barrier between the core of the cable and the jacket. It is to be appreciated that an advantage of this embodiment of the invention is that the rod helps to reduce signal attenuation effects that result, for example, from the jacket, and also helps to reduce alien crosstalk based on the principles that have been described herein. According to this embodiment, the cable (core, rod, jacket etc.) is cabled in a direction opposite to the helical wrapping of the rod, for example, in an anti-clockwise direction for the rod wrapped in the clockwise direction. Because the rod twist and the cable lay are in opposite directions, the rod is "contra-helically" wrapped.

It is to be appreciated that variations to this embodiment can also be provided such as multiple rods can also be applied in opposite directions, for example, in a crosshatch pattern. It should also be understood that the at least one rod can be applied in a varying lay, for example, over a range from about 0.5 inches to about 30 inches. Also, it is to be appreciated that according to some aspects, the rod may be secured to the core of the cable. Furthermore, it is to be appreciated that the jacket may be formed with a plurality of protrusions 206 extending away from an inner circumferential surface of the jacket such as and disclosed in commonly owned U.S. Pat. No. 7,135,641 which is herein incorporated by reference, wherein the plurality of protrusions cause core of the jacket to be kept away from the inner circumferential surface of the jacket, and serve a similar purpose as the contra helical wrapped rod. It is to be further appreciated that according to some aspects of the invention, this "contra-helically" wrapped cable can be manufactured in one operation or in other words at the same time. For example, an applicator for extruding the dielectric rod can be configured to spin in the opposite direction of the cable lay during the cabling operation.

According to another embodiment of the invention, any of the herein described cables, whether previously known or those according to the invention, can be provided with at least one helically wrapped rod (wrapped in the same direction as the cable is twisted) about a circumference of the cable (not illustrated). The rod can be any dielectric for an UTP cable (and could be metallic if cable includes a shield) that is wrapped around the core of the UTP cable. By core, for this embodiment too, it is understood that the core comprises the twisted pairs of conductors, any separator if one is provided in the cable, and as optional binder to keep the twisted pairs and any separator together. The at least one dielectric rod is helically wrapped around the core, for example, in a clockwise direction to provide a barrier between the core of the cable and the jacket. It is to be appreciated that an advantage of this embodiment of the invention is also that the rod helps to reduce signal attenuation effects that result, for example, from the jacket, and also helps to reduce alien crosstalk based on the principles that have been described herein. For this embodiment, it is understood that the cable (core, rod, jacket etc.)is cabled in a same direction as the helical wrapping of the rod.

It is to be appreciated the at least one rod can be applied in a varying lay, for example, over a range from about 0.5 inches to about 30 inches. Also, it is to be appreciated that according to some aspects, the rod may be secured to the core of the cable. It is to be further to be appreciated that the jacket may be formed with a plurality of protrusions 206 extending away from an inner circumferential surface 208 of the jacket such as illustrated in FIG. 20 and disclosed in commonly owned U.S. Pat. No. 7,135, 641 which is herein incorporated by reference, wherein the plurality of protrusions cause the plurality the core of the cable to be kept away from the inner circumferential surface of the jacket, and serve a similar purpose as the helical wrapped rod. It is to be further appreciated that according to some aspects of the invention, this "helically" wrapped cable can be manufactured in one operation or in other words at the same time. For example, an applicator for extruding the dielectric rod can be configured to spin in the direction of the cable lay during the cabling operation. According to some aspects, the "twist lay" of the rod about the core can be configured to substantially match the cable lay. Alternatively, according to another aspect an applicator can be configured to spin faster than the cable core in the direction of the cable lay during the cabling operation so as to provide for a rod wrap length or lay that is shorter than the cable lay.

Figure 17:
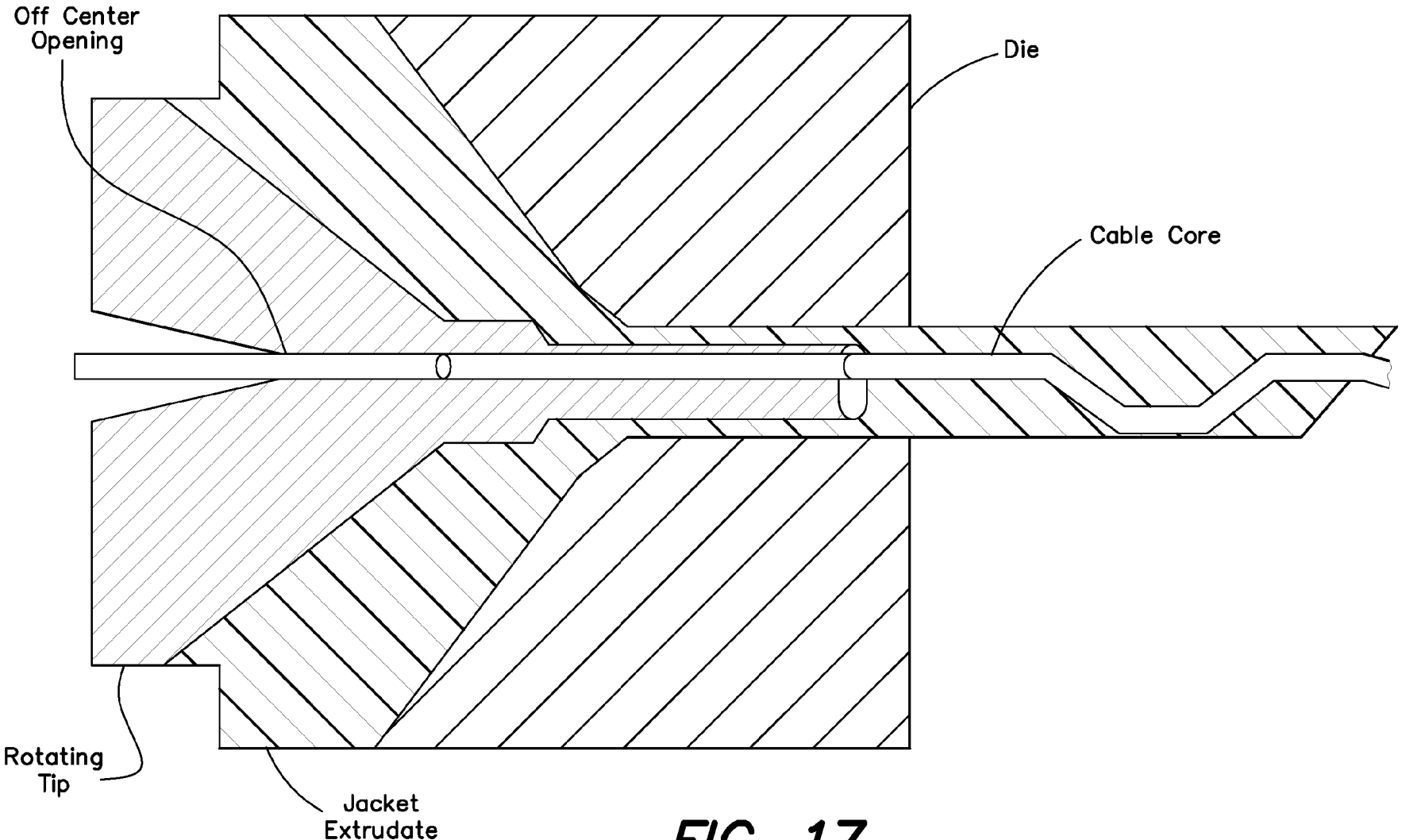
FIG. 17 illustrates an oscillating core embodiment of a twisted pair cable according to aspects of the invention.
Figure 18A:
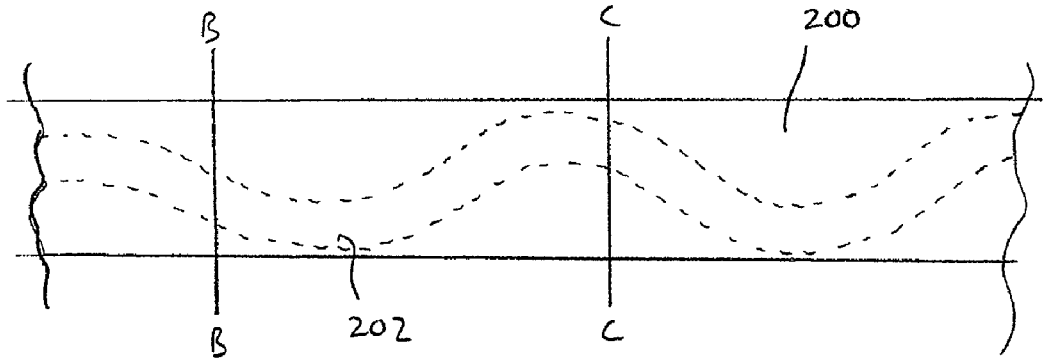
FIG. 18A is an illustration of oscillating core embodiment of a twisted pair cable according to aspects of the invention.
Figure 18B:
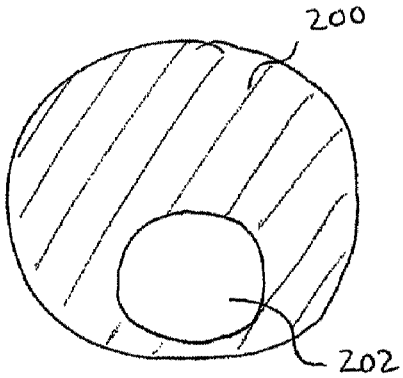
FIG. 18B is a cross-sectional diagram of the oscillating core of FIG. 18A, taken along line B-B.
Figure 18C:
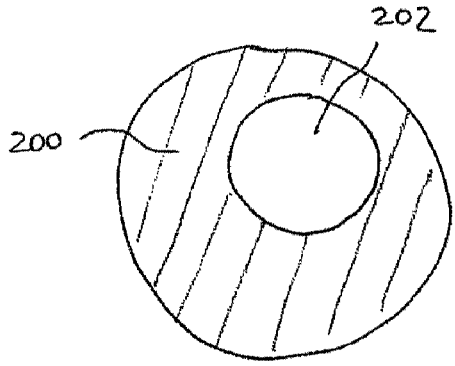
FIG. 18C is a cross-sectional diagram of the oscillating core of FIG. 18A, taken along line C-C.

According to another embodiment of the invention, any of the previously known or herein described cables according to the invention, can be provides as an oscillating core within a jacket. FIG. 17 illustrated a device for extruding an oscillating core embodiment of a twisted pair cable. By core, for this embodiment too, it is understood that the core comprises the twisted pairs of conductors, any separator if one is provided in the cable, and an optional binder to keep the twisted pairs and any separator together. According to this embodiment, the cable core 202 is oscillated within the jacket (varying center) producing a cable jacket 200 having varying wall thickness around the circumference of the cable and the cable core 202 as illustrated in FIGS. 18A-C. The cable core is fed into a rotating tip as illustrated in FIG. 17, with the tip being provided so that it is off-center and rotates. A jacket is extruded over this tip, through a die as illustrated in FIG. 17 as the core is rotated. According to one embodiment, the outside of the tip (or guide) is centered within the die, and the rotating tip causes the cable core to be off-center within the jacket. It is to be appreciated that an advantage of this embodiment of the invention is also that the oscillating core helps to reduce alien crosstalk based on he principles that have been described herein. For this embodiment, it is understood that the cable (core, jacket) is cabled in a same direction as the helical rotation of the core. It is to be understood that the tip and thus the core of the cable can be rotated with various frequencies of rotation. Furthermore, it is to be appreciated that the jacket may be formed with a plurality of protrusions 206 extending away from an inner circumferential surface 208 of the jacket such as illustrated in FIG. 20 and disclosed in commonly owned U.S. Pat. No. 7,135,641 which is herein incorporated by reference, wherein the plurality of protrusions cause the core to be kept away from the inner circumferential surface of the jacket and serve a similar purpose as the oscillating core.

According to another embodiment of the invention, any of the previously known or herein described cables according to the invention, can be provided as an oscillating core within a jacket (not illustrated). By core, for this embodiment too, it is understood that the core comprises the twisted pairs of conductors, any separator if one is provided in the cable, and an optional binder to keep the twisted pairs and any separator together. According to this embodiment, a jacket having an undulating wall tightness about the core is provided along the length of the cable. The jacket preferably has substantially the same thickness, and is provided so that the jacket moves from in contact with the core to away from the core. This jacket may be provided during extrusion of the jacket so that in some areas (lengthwise along the cable), the jacket is tightly held to the core, whereas in other areas, it's held more loosely during formation so that it is less tight about the core, so that the size of the outer circumference of the jacket changes, but the jacket thickness remains substantially the same. According to some aspects, the frequency of the undulations are random, thereby reducing any periodicity that may cause structural return loss and attenuation issues. Furthermore, it is to be appreciated that the jacket may be formed with a plurality of protrusions extending away from an inner circumferential surface of the jacket such as disclosed in commonly owned U.S. Pat. No. 7,135,641 which is herein incorporated by reference, wherein the plurality of protrusions cause the core to be kept away from the inner circumferential surface of the jacket, and serve a similar purpose as the undulating jacket tightness.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A cable comprising:

a first twisted pair of insulated conductors;

a second twisted pair of insulated conductors;

a separator positioned so as to separate the first twisted pair from the second twisted pair; and a jacket disposed about the first and second twisted pairs and the separator;

wherein the separator comprises a central arm and at least one enlarged portion positioned at one end of the central arm and positioned at least partially around the first twisted pair of insulated conductors so as to create an outward projection of the jacket: and wherein the at least one enlarged portion wraps around the first twisted pair of insulated conductors such that a line drawn from a center of the central arm of the separator and through a center of the first twisted pair of conductors substantially bisects the enlarged portion.

2. The cable of claim 1, wherein the first and second twisted pair of insulated conductors and the separator comprise a core of the cable, wherein the jacket is provided with a plurality of protrusions extending away from an inner circumferential surface of the jacket, and wherein the plurality of protrusions are configured to cause the core to be kept away from the inner circumferential surface of the jacket.

3. The cable of claim 1, further comprising a third twisted pair of insulated conductors and a fourth twisted pair of insulated conductors, wherein the separator separates the first and third twisted pairs from the second and fourth twisted pairs, and wherein the first twisted pair has a shortest twist lay of the first, second, third and fourth twist pairs.

4. The cable of claim 1, wherein at least one enlarged portion has an oblong shape.

5. The cable of claim 1, wherein the separator further comprises a second arm coupled to the central arm.

6. The cable of claim 5, further comprising a third twisted pair of insulated conductors and a fourth twisted pair of insulated conductors, and wherein the second arm is constructed to separate the third twisted pair from the first twisted pair and the fourth twisted pair from the second twisted pair.

7. The cable of claim 5, wherein the second arm comprises a second enlarged portion positioned at an end of the second arm.

8. The cable of claim 5, further comprising at least one additional arm coupled to at least one of the first arm and the second arm.

9. The cable of claim 1, further comprising a third twisted pair of insulated conductors and a fourth twisted pair of insulated conductors, wherein the separator separates the first and third twisted pairs from the second and fourth twisted pairs, wherein the first twisted pair, the second twisted pair, the third twisted pair, the fourth twist pair and the separator make up a core of the cable, and wherein the core is helically wrapped with a dielectric rod.

10. The cable of claim 9, wherein the dielectric rod is wrapped about the core in a same direction that the cable is twisted.

11. The cable of claim 9, wherein the dielectric rod is wrapped about the core in an opposite direction than that which the cable is twisted.

12. The cable of claim 1, further comprising a third twisted pair of insulated conductors and a fourth twisted pair of insulated conductors, wherein the separator separates the first and third twisted pairs from the second and fourth twisted pairs, wherein the first twisted pair, the second twisted pair, the third twisted pair, the fourth twist pair and the separator make up a core of the cable, and wherein the core is oscillated about the center of the cable within the jacket.

13. The cable of claim 12, wherein the core is oscillated in a same direction as the cable is twisted.

14. The cable of claim 1, further comprising a third twisted pair of insulated conductors and a fourth twisted pair of insulated conductors, wherein the separator separates the first and third twisted pairs from the second and fourth twisted pairs, wherein the first twisted pair, the second twisted pair, the third twisted pair, the fourth twist pair and the separator make up a core of the cable, and wherein the jacket is extruded along the length of the cable with substantially the same thickness and with varying tightness of the jacket to the core of the cable.

15. The cable of claim 14, wherein a frequency of the varying tightness of the jacket to the core of the cable is random.

* * * * *

UNITED STATES PATENT AND TRADEMARK OFFICE

CERTIFICATE OF CORRECTION

PATENT NO. : 7,449,638 B2
APPLICATION NO. : 11/608320
DATED : November 11, 2008
INVENTOR(S) : William T. Clark et al.

It is certified that error appears in the above-identified patent and that said Letters Patent is hereby corrected as shown below:

In column 17, line 19, “contra helical” should be changed to --contra-helically--.

In column 18, line 8, “provides” should be changed to --provided--.

Signed and Sealed this

Third Day of March, 2009

JOHN DOLL
*Acting Director of the United States Patent and Trademark Office*